US007806113B2

(12) United States Patent
Skilling

(10) Patent No.: US 7,806,113 B2
(45) Date of Patent: Oct. 5, 2010

(54) COMPRESSED GAS PROJECTILE ACCELERATOR HAVING MULTIPLE PROJECTILE VELOCITY SETTINGS

(75) Inventor: Jay Edward Skilling, 11554 Rousseau, San Antonio, TX (US) 78251

(73) Assignee: Jay Edward Skilling, San Antonio, TX (US)

( * ) Notice: Subject to any disclaimer, the term of this patent is extended or adjusted under 35 U.S.C. 154(b) by 0 days.

(21) Appl. No.: 12/069,086

(22) Filed: Feb. 7, 2008

(65) Prior Publication Data

US 2009/0199830 A1 Aug. 13, 2009

(51) Int. Cl.
*F41B 11/00* (2006.01)

(52) U.S. Cl. ..... 124/73

(58) Field of Classification Search ..... 124/74, 124/73, 75, 71, 48, 80, 1, 3, 77
See application file for complete search history.

(56) References Cited

U.S. PATENT DOCUMENTS

| | | | | | |
|---|---|---|---|---|---|
| 2,791,944 | A | * | 5/1957 | Harvey | 89/193 |
| 3,420,220 | A | * | 1/1969 | Ferrando | 124/71 |
| 4,030,097 | A | | 6/1977 | Gedeon | |
| 4,184,156 | A | | 1/1980 | Petrovsky et al. | |
| 4,276,548 | A | | 6/1981 | Lutz | |
| 4,499,630 | A | | 2/1985 | Harris et al. | |
| 4,819,609 | A | | 4/1989 | Tippmann | |
| 4,881,707 | A | | 11/1989 | Garfinkle | |
| 5,081,901 | A | * | 1/1992 | Kemeny et al. | 89/8 |
| 5,333,594 | A | | 8/1994 | Robinson | |
| 5,383,442 | A | | 1/1995 | Tippmann | |
| 5,462,042 | A | | 10/1995 | Greenwell | |
| 5,570,094 | A | | 10/1996 | Armstrong | |
| 5,613,483 | A | | 3/1997 | Lukas et al. | |
| 5,727,538 | A | * | 3/1998 | Ellis | 124/77 |
| 5,755,213 | A | | 5/1998 | Gardner, Jr. et al. | |
| 5,878,736 | A | | 3/1999 | Lotuaco, III | |
| 5,957,119 | A | | 9/1999 | Perry et al. | |
| 5,967,133 | A | | 10/1999 | Gardner, Jr. | |
| 6,003,504 | A | | 12/1999 | Rice et al. | |
| 6,035,843 | A | | 3/2000 | Smith et al. | |

(Continued)

FOREIGN PATENT DOCUMENTS

| | | |
|---|---|---|
| GB | 2342710 | 4/2000 |

(Continued)

OTHER PUBLICATIONS

ASTM International; Standard Practice for Paintball Field Operation; Designation F1777-02; Copyright Dec. 30, 2007.

(Continued)

*Primary Examiner*—Troy Chambers
*Assistant Examiner*—Reginald Tillman, Jr.
(74) *Attorney, Agent, or Firm*—Krieg DeVault LLP

(57) ABSTRACT

A compressed gas projectile accelerator that includes a velocity adjustment mechanism and/or method configured to allow the compressed gas projectile accelerator to expel projectiles between a first velocity setting and a second velocity setting. The velocity adjustment mechanism and/or method includes a velocity controller configured to allow a user to selectively select a velocity setting falling between the first velocity setting and the second velocity setting. The first velocity setting comprises an upper or maximum velocity setting and the second velocity setting comprises a lower or minimum velocity setting.

16 Claims, 20 Drawing Sheets

U.S. PATENT DOCUMENTS

| | | | | |
|---|---|---|---|---|
| 6,065,460 | A | 5/2000 | Lotuaco, III | |
| 6,138,656 | A | 10/2000 | Rice et al. | |
| 6,311,682 | B1 | 11/2001 | Rice et al. | |
| 6,349,711 | B1 | 2/2002 | Perry et al. | |
| 6,378,367 | B1 | 4/2002 | Dilz, Jr. | |
| 6,474,326 | B1 | 11/2002 | Smith et al. | |
| 6,590,386 | B1 | 7/2003 | Williams | |
| 6,615,814 | B1 | 9/2003 | Rice et al. | |
| 6,637,421 | B2 | 10/2003 | Smith et al. | |
| 6,644,295 | B2 | 11/2003 | Jones | |
| 6,644,296 | B2 | 11/2003 | Gardner, Jr. | |
| 6,658,982 | B2 | 12/2003 | Cherry | |
| 6,708,685 | B2 * | 3/2004 | Masse | 124/75 |
| 6,748,938 | B2 | 6/2004 | Rice et al. | |
| 6,810,871 | B2 | 11/2004 | Jones | |
| 6,860,259 | B2 | 3/2005 | Rice et al. | |
| 6,898,971 | B2 | 5/2005 | Dilz, Jr. | |
| 6,901,923 | B2 | 6/2005 | Jones | |
| 6,904,902 | B2 * | 6/2005 | Axelsson | 124/73 |
| 6,941,693 | B2 | 9/2005 | Rice et al. | |
| 6,966,313 | B1 | 11/2005 | Yokota et al. | |
| 6,973,748 | B2 | 12/2005 | Rice | |
| 7,069,922 | B1 | 7/2006 | Orr | |
| 2003/0106454 | A1 * | 6/2003 | Olbort | 104/35 |
| 2003/0106545 | A1 * | 6/2003 | Verini | 124/74 |
| 2004/0065310 | A1 | 4/2004 | Masse | |
| 2004/0237953 | A1 * | 12/2004 | Axelsson | 124/73 |
| 2007/0017496 | A1 | 1/2007 | Hill, Sr. | |
| 2007/0017497 | A1 | 1/2007 | Masse | |
| 2007/0068502 | A1 | 3/2007 | Jones et al. | |
| 2007/0107711 | A1 | 5/2007 | Leal et al. | |
| 2007/0151551 | A1 * | 7/2007 | Verini | 124/74 |
| 2009/0025701 | A1 * | 1/2009 | Douglas et al. | 124/77 |

FOREIGN PATENT DOCUMENTS

| | | |
|---|---|---|
| GB | 2345953 | 7/2000 |
| GB | 2352022 | 1/2001 |
| WO | WO 99/42912 | 8/1999 |
| WO | WO 2006/020861 | 2/2006 |
| WO | WO 2006/124392 | 11/2006 |

OTHER PUBLICATIONS

Cossio Insurance Agency; Paintball / Lasertag / Airsoft Insurance Application; undated.

National Professional Paintball League, Inc.; Official Rule Book 2007; Copyright 2007.

National Sports Entertainment Recreation Association; Paintball Field General Liabilty Insurance Application; Copyright 2006.

Planet Esclipse LTD; EGO8 Advanced Paintball Marker Operators Manual; Copyright 2007-2008.

Smart Parts; Shocker NXT Operation and adjustment instructions; Manual Version 1.4.

Worr Game Products; Owners Manual for Ranger Series; Undated.

BT Paintball Designs; BT-16 High Performance Paintball Marker User Manual: Tactical / Elite / Field; Undated.

Kingman Group; Spyder Users Manual, E-MR1; Undated.

WDP LTD; Angel G7 Operators and Users Manual; Copyright 2005.

Dye Precision, Inc.; Proto Paintball SLG Owner's Manual; Copyright 2008.

Indian Creek Design, Inc.; Freestyle FS-8 OPeration Manual; Version 1.4; Copyright 1992 . . . 2006.

Kee Action Sports; Evil Minion Operator's Manual 2.0; Copyright 2007.

Tippman; 98 Custom Owner's Manual; Copyright Jun. 2005.

Bill Mills; Tippmann X7; Corinthian Media Services, Copyright Nov. 2007.

Bill Mills; Tippmann X7; Corinthian Media Services, Copyright Nov. 2007. (Different publication than #15 cited above.).

Bill Mills; BT-16 Elite; Corinthian Media Services, Copyright Sep. 2005.

Bill Mills; Smart Parts' Ion; Corinthian Media Services, Copyright Aug. 2005.

Bill Mills; Shocker NXT; Corinthian Media Services, Copyright Aug. 2007.

Bill Mills; Infinity Legend; Corinthian Media Services, Copyright Apr. 2007.

Corinthian Media Services; The care and feeding of a Spyder; Copyright 1992-2008.

Hillclimb Media; Inside Paintball Technology: The JT TAC-5; Action Pursuit Games Magazine, Copyright 2000-2007.

International Search Report issued Apr. 6, 2009 for PCT Patent Application PCT/US2009/00752.

* cited by examiner

COMPRESSED GAS PROJECTILE ACCELERATOR HAVING MULTIPLE PROJECTILE VELOCITY SETTINGS

BACKGROUND

The present invention relates generally to compressed gas projectile accelerators and more particularly, to compressed gas projectile accelerators configured to allow players to select one of a plurality of velocity settings on the fly during play without the use of tools.

In the sport of paintball, the maximum velocity at which projectiles are permitted to be expelled from the barrel of a paintball gun or marker is tightly controlled in both recreational and tournament play. Most tournaments and recreational paintball venues only permit a paintball marker to shoot paintballs at a maximum velocity of 300 feet per second ("FPS"). All markers are subjected to testing by chronographs before and sometimes after a tournament round or match. Some tournaments even randomly take chronograph readings of players' markers during actual tournament play. Shooting a hot marker, one that shoots paintballs at over 300 FPS, can subject a player or team to disqualification, a loss of points, or the player not being allowed on the field.

Current paintball markers provide methods to adjust the speed at which a projectile is expelled from the marker. However, once the speed of the marker is adjusted to just below the maximum permitted velocity setting, the marker is not capable of being easily readjusted without the use of a tool, such as an allen wrench. Carrying tools that can be used to adjust marker velocity settings onto the field is strictly prohibited. As such, the paintball marker is only capable of being adjusted to operate on the field at one set velocity setting.

SUMMARY

One embodiment of the present application discloses a compressed gas projectile accelerator that is capable of expelling projectiles at a plurality of user selected velocity settings that do not exceed a maximum allowed velocity setting. Other embodiments include unique apparatus, devices, systems, and methods for expelling projectiles from a compressed gas projectile accelerator at user selected varying velocities so that users are capable of lobbing projectiles at targets as well as shooting straight at targets. Further embodiments, forms, objects, features, advantages, aspects, and benefits of the present application shall become apparent from the detailed description and figures included herewith.

BRIEF DESCRIPTION OF THE DRAWINGS

The figures are not necessarily to scale, emphasis instead being placed upon illustrating the principles of the invention. Moreover, in the figures, like reference numerals designate corresponding parts throughout the different views.

DETAILED DESCRIPTION

Figure 1:
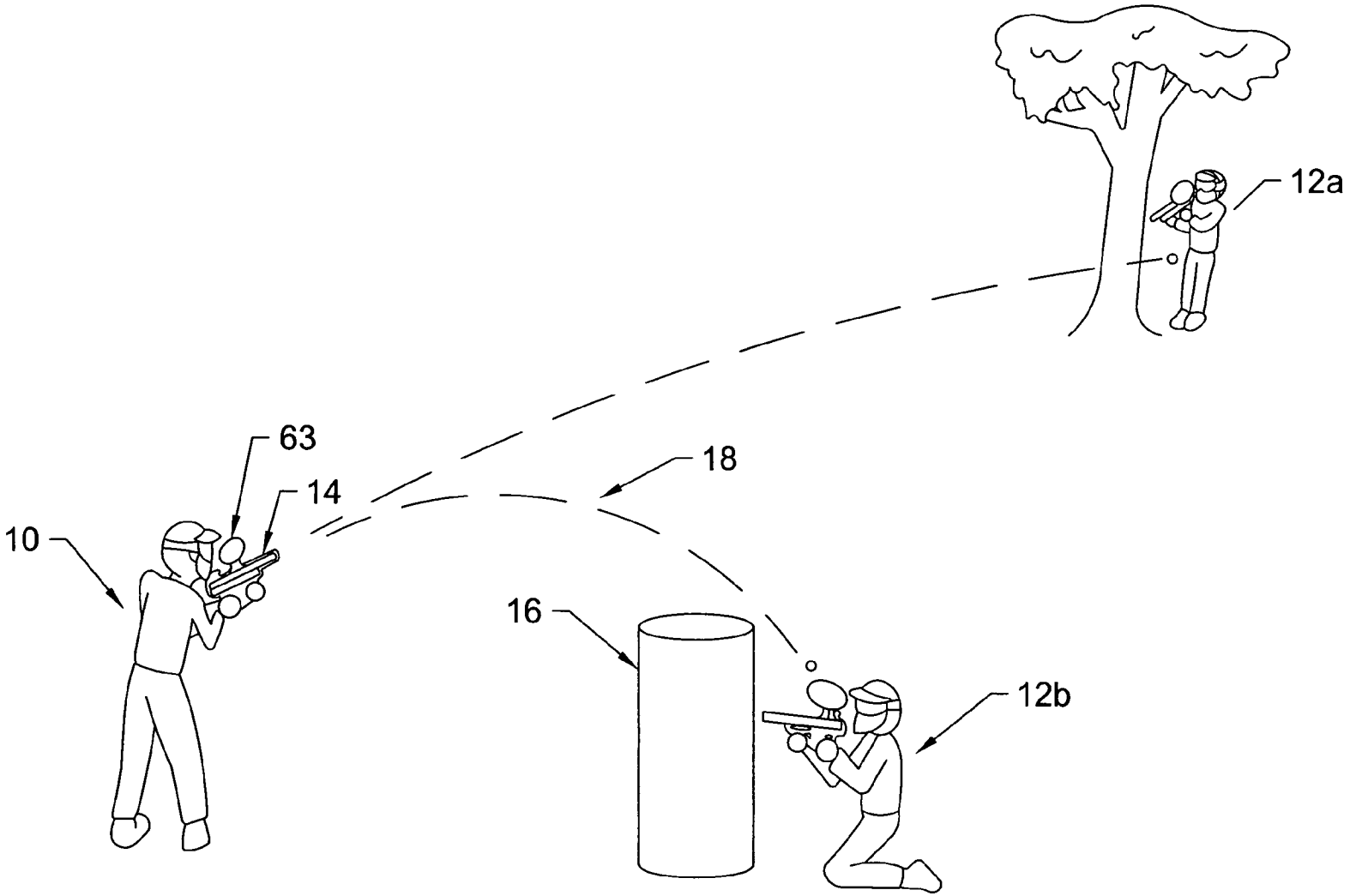
FIG. 1 illustrates a player shooting projectiles at targets on a paintball playing field using a compressed gas projectile accelerator.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Referring to FIG. 1, a user 10 is illustrated firing projectiles or paintballs at two respective targets 12*a*, 12*b* using a compressed gas projectile accelerator or paintball marker 14. User 10 is shooting at target 12*a* with a marker 14 that is set or configured to expel paintballs at target 12*a* at an upper velocity setting, which in this form comprises the maximum allowable velocity setting of 300 FPS. As illustrated, since user 10 is a substantial distance from target 12*a*, thus requiring the paintball to travel a greater distance (e.g. ~200 feet), the paintball tends to travel along somewhat of an arced path after traveling a predetermined distance due to the force of gravity on the paintball.

As further illustrated, user 10 is somewhat closer to target 12*b* (e.g. ~80 feet) who is hiding behind an obstacle 16, which is illustrated as a barrel for representative purposes only. If user 10 fires a paintball at target 12*b* with marker 14 set at the upper velocity setting, it would be extremely difficult, if not impossible, for user 10 to hit target 12*b* due to the fact that obstacle 16 is providing cover for target 12*b*. This is because the paintball will travel along a relatively straight path toward target 12*b* thereby causing the paintball to strike obstacle 16 and not target 12*b*. Despite the effect that gravity has on the paintball, at the maximum allowed velocity setting, paintballs are expelled from the marker 14 along a relatively straight path over short distances, which are the typical distances encountered on the field when shooting at a respective target 12*a*, 12*b*.

If user 10 was able to lower the velocity at which paintballs are expelled from the barrel of marker 14 to lets say, for example, 180 FPS, as well as adjust the angle of the barrel of marker 14 upward at a predetermined angle, the likelihood of user 10 being able to strike target 12*b* behind obstacle 16 with a paintball is greatly improved. This is because the paintball will travel along a substantially arc shaped path 18 as a function of the speed at which the paintball exits the barrel and the angle of the barrel. Therefore, as illustrated in FIG. 1, user 10 is capable of "lobbing" a paintball onto target 12*b* thereby eliminating the player, which is illustrated as target 12*b*.

Figure 2:
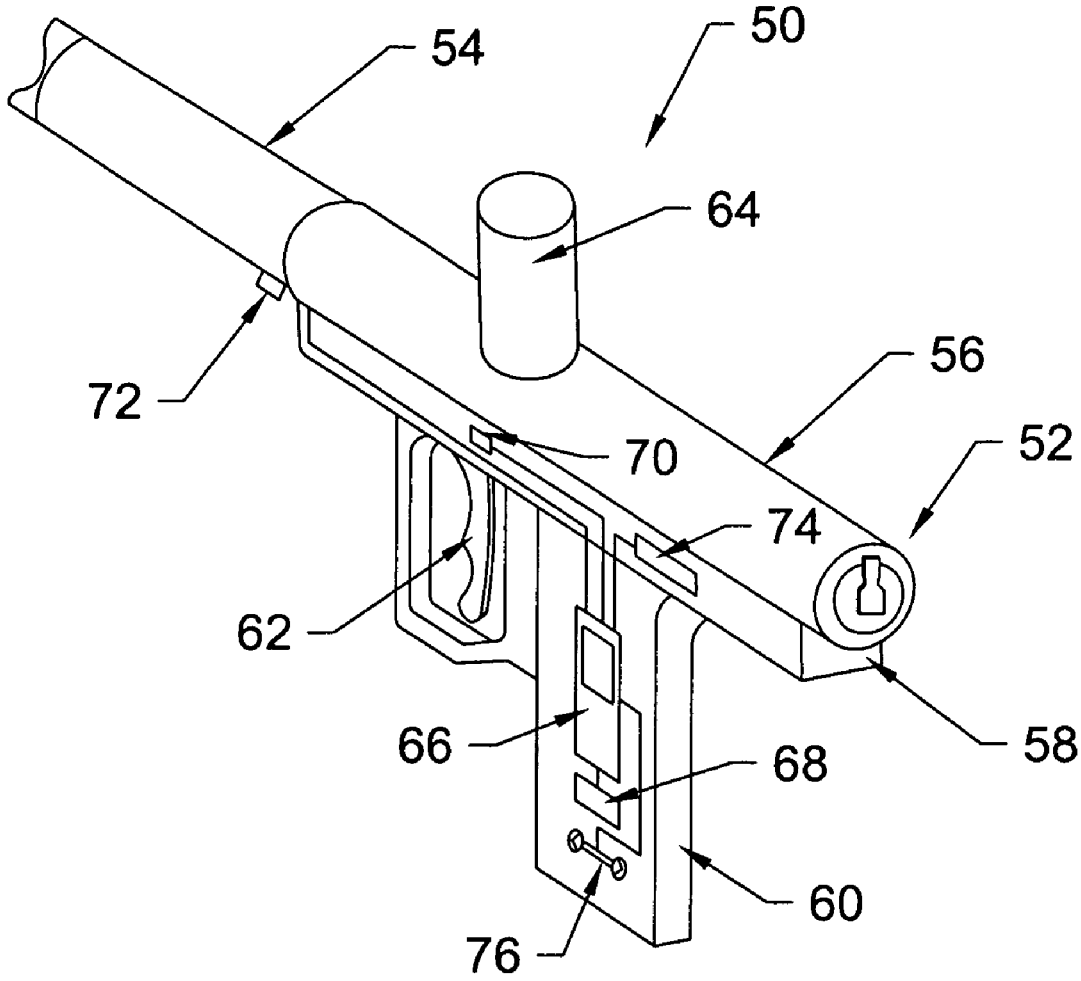
FIG. 2 is a cross-sectional view of an illustrative compressed gas projectile accelerator.

Referring to FIG. 2, a representative paintball marker 50 is illustrated that includes an on the fly velocity adjustment mechanism 52. Velocity adjustment mechanism 52 is operably configured to allow user 10 to manually and selectively adjust the velocity at which paintballs are expelled from a barrel 54 of the marker 50. Marker 50 is configured to expel projectiles from marker 50 at a range of velocities ranging from an upper velocity setting to a lower velocity setting. In one form, the upper velocity setting corresponds to the maximum velocity at which a paintball is allowed to be expelled from barrel 54, which may be 300 FPS for example. Further, in one form, the lower velocity setting corresponds to the lowest possible velocity setting at which marker 50 is capable of expelling a paintball from barrel 54. As those skilled in the art would recognize, different user preferred upper and lower velocity settings may be utilized in various other forms of the present invention.

In one form, marker 50 includes a housing or frame body 56, a grip frame rail 58, a grip or grip frame 60, a trigger mechanism 62, and a feed tube 64 for a projectile or paintball hopper 63 (See FIG. 1). As illustrated, body 56 is connected with grip frame rail 58 or alternatively grip frame rail 58 may be an integral part of body 56. Barrel 54 is connected with one respective end of body 56 and, in this illustrative form, velocity adjustment mechanism 52 is connected with the opposite end of body 56. Feed tube 64, which a paintball hopper (not shown) is removably connected with and feeds paintballs to marker 50, is also connected with or formed as part of body 56. Trigger mechanism 62 is movably connected with grip frame rail 58 and is configured to, with each trigger pull, expel a paintball from barrel 54 (at least in semi-automatic firing mode). In automatic firing mode, a plurality of paintballs are expelled from barrel 54.

In another representative form, an electro-pneumatic marker 50 is disclosed that includes an electronic circuit board 66 and a power source 68. Although illustrated as being housed in grip frame 60, it should be appreciated that circuit board 66 and power source 68 may be housed in other locations of marker 50. Power source 68 is connected with circuit board 66 and provides power to circuit board 66. Electro-pneumatic marker 50 includes a trigger sensor 70 that is connected with circuit board 66. A velocity or speed sensor 72 and a solenoid valve 74 are also connected with circuit board 66. Speed sensor 72 could comprise a laser, an optical eye, a LED speed sensor, or any other suitable type of speed sensor. As set forth in greater detail below, in this form, a velocity controller 76 is also connected with circuit board 66.

Figures 3A, 3B, 3C:
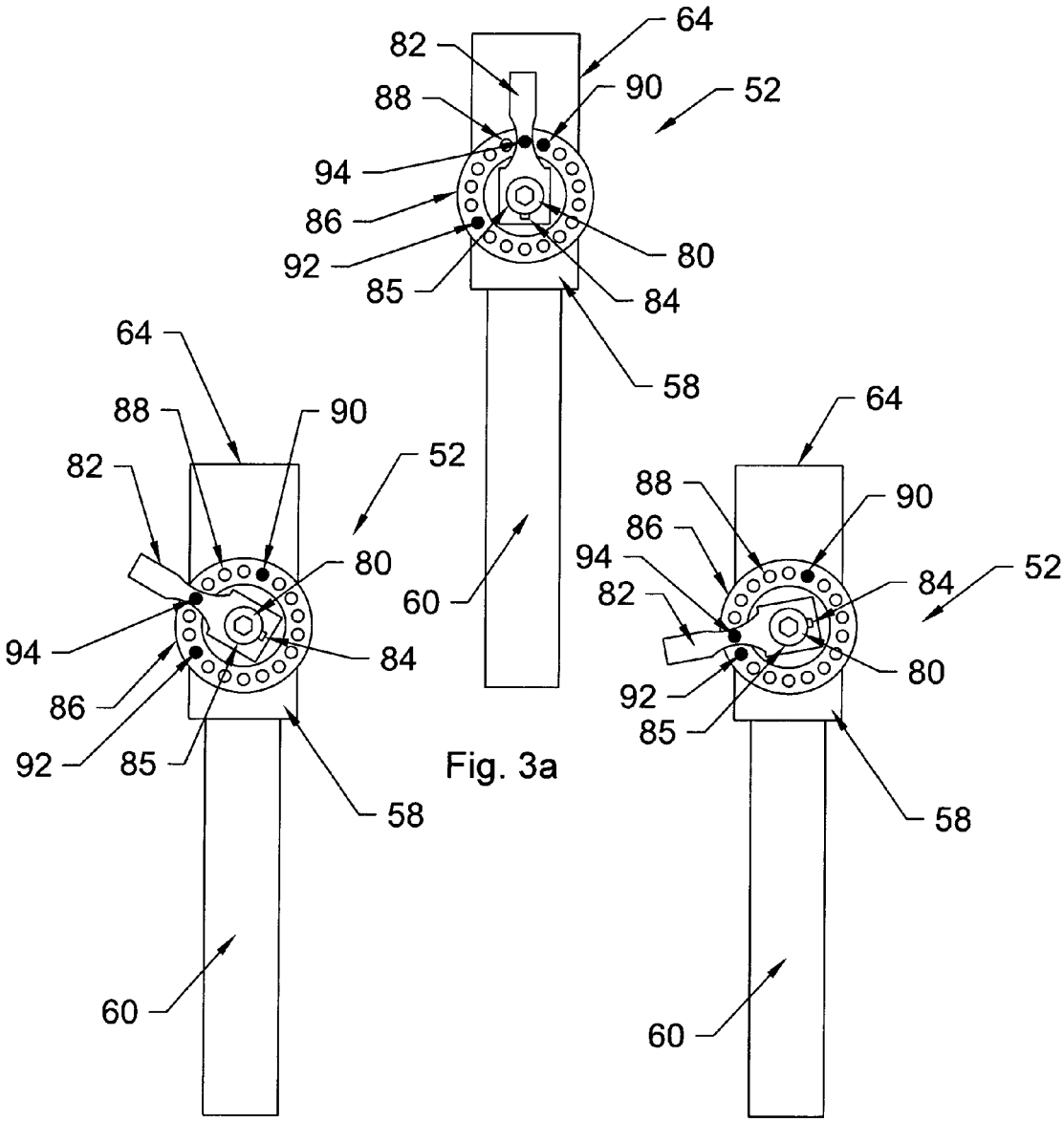
FIGS. 3*a*-3*c* set forth rear views of a compressed gas projectile accelerator including a velocity adjustment mechanism.

Referring collectively to FIGS. 3*a*-3*c*, a rear view of marker 50 is depicted to better illustrate one form of velocity adjustment mechanism 52. In this form, velocity adjustment mechanism 52 includes a main velocity adjustor 80. Main velocity adjustor 80 is configured to adjust a velocity setting of marker 50. In particular, main velocity adjustor 80 is configured to adjust marker 50 so that marker 50 cannot expel paintballs above a predetermined upper or maximum velocity setting, which, for illustrative purposes only, is at or below 300 FPS. In this illustrative example, main velocity adjustor 80 comprises an allen head screw configured to adjustably control the upper velocity setting of marker 50. For example, adjustment of main velocity adjustor 80, by tightening or loosening main velocity adjustor 80, increases or decreases the maximum velocity setting of marker 50.

Velocity adjustment mechanism 52 includes an adjustment device or member 82 that is connected with main velocity adjustor 80. In this form, adjustment device 82 comprises a lever selector that is secured to main velocity adjustor 80 with a retention member or set screw 84. Adjustment device 82 includes an aperture 85 that fits around an outside diameter of main velocity adjustor 80. Once main velocity adjustor 80 is set to cause marker 50 to function at the user preferred or authorized upper velocity setting, which is just below 300 FPS in this example, lever selector 82 is positioned about a dial 86 in a user selected position and then set screw 84 is used to tightly secure lever selector 82 to main velocity adjustor 80. In this example, as illustrated in FIG. 3*a*, user 10 has selected a twelve o-clock position for lever selector 82 as the setting for the maximum or upper velocity setting.

In order to prevent user 10 from being able to turn lever selector 82 clockwise, thereby increasing the velocity at which a projectile may be expelled, lever selector 82 must be restricted. As previously discussed, any velocity above the upper or maximum velocity setting would cause marker 50 to be viewed as a "hot marker" as understood by those skilled in the art. In this example, dial 86 includes a plurality of apertures 88 that are positioned around a circumference or perimeter of dial 86. A blocking pin 90 is positioned or placed in a respective aperture 88 immediately next to lever 82 to prevent lever selector 82 from being rotated any further in the clockwise direction. As such, this prevents user 10 from being able to adjust the velocity setting of marker 50 above the upper velocity setting. This is an important feature as user 10 would not be allowed to use marker 50 if he/she was capable of adjusting marker 50 to shoot above the maximum allowed velocity setting by simply moving lever selector 82.

In this form, as user 10 rotates lever selector 82 counterclockwise, the velocity at which paintballs are expelled from barrel 54 of marker 50 begins to decrease. For example, at the setting illustrated in FIG. 3*b*, marker 50 is set to expel paintballs at approximately 215 FPS. The further lever selector 82 is adjusted counterclockwise, the velocity at which paintballs are expelled from marker 50 decreases until, as illustrated in FIG. 3*c*, lever selector 82 reaches a lower velocity setting. In FIG. 3*c*, the lower velocity setting is controlled by placement of a blocking pin 92 in another user selected aperture 88 of dial 86.

During operation, lever selector 82 will hit or bump up against pins 90 and 92, which do not allow lever selector 82 to be adjusted any further beyond the upper and lower velocity settings. Selector 82 may also include a detainment mechanism, which is a detent 94 in this example, that is located in alignment with apertures 88 on dial 86 to help temporarily secure the selector 82 in place once a velocity setting is chosen by user 10. Pins 90, 92 may comprise standard pins, set screws, or any other type of equivalent device that will restrict movement of lever selector 82 beyond the upper and lower velocity settings. Apertures 88 may be threaded and in one form, dial 86 is connected to body 56 of marker 50 and in another form, dial 86 is formed as an integral part of body 56 or other components of marker 50 disclosed herein.

Figure 4A:
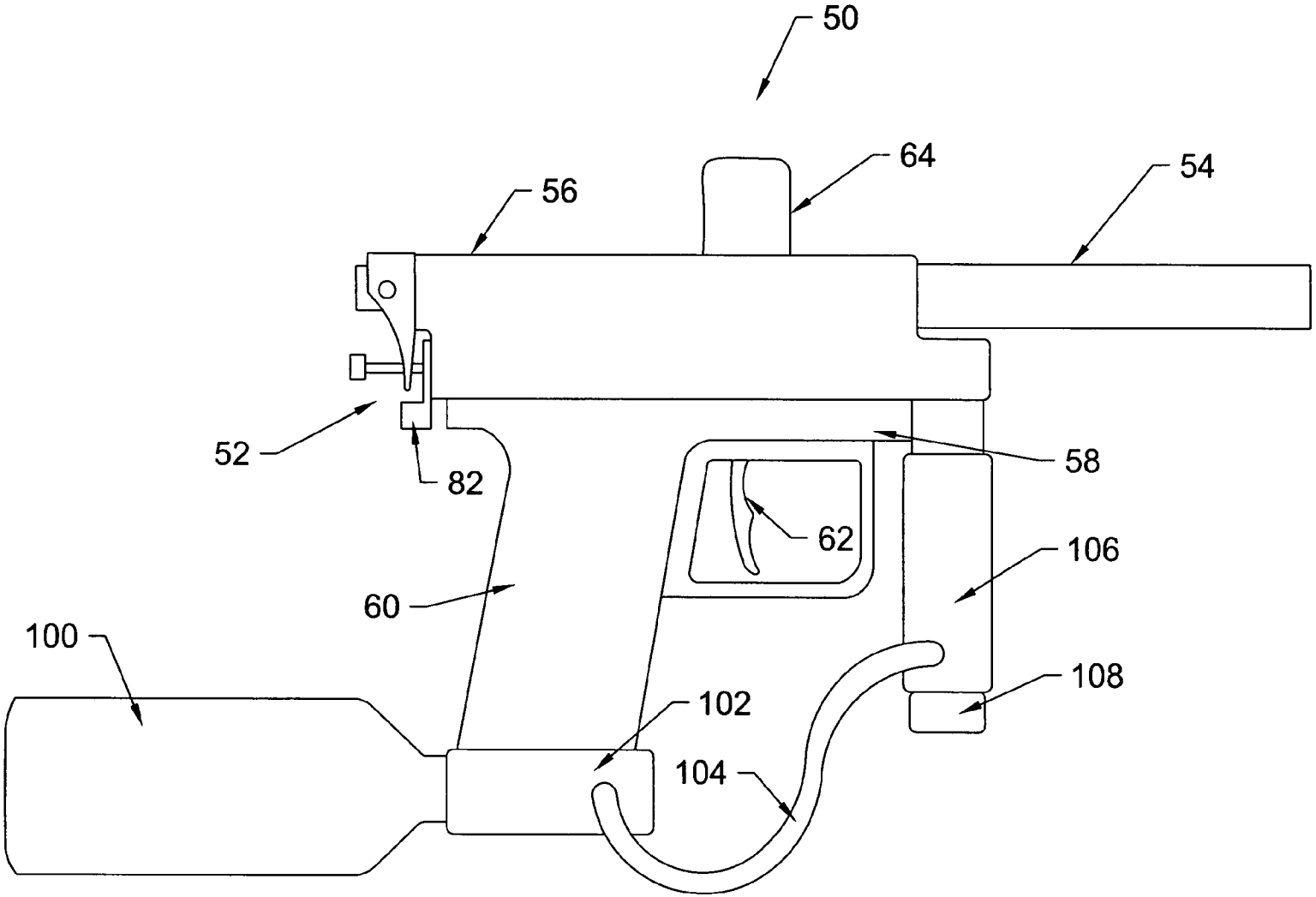
FIGS. 4*a*-4*c* illustrates side views of a compressed gas projectile accelerator including velocity adjustment mechanisms positioned at different locations.

Referring to FIG. 4*a*, a side view of one illustrative form of marker 50 is illustrated showing velocity adjustment mechanism 52 located directly on marker 50. In this form, velocity adjustment mechanism 52 is illustrated as being located or positioned at the back or rear of body 56; however, those skilled in the art should appreciate that velocity adjustment mechanism may be located at several other positions on marker 50. Marker 50 includes a compressed gas source 100, which may contain compressed air, $CO_2$, nitrogen, or any other type of suitable compressed gas, which is removably connected with a tank adapter 102 of marker 50. The compressed gas stored in source 100 is used to selectively expel projectiles from barrel 54 of marker 50.

In this illustrated form, a gas line 104 connects an output of tank adapter 102 to a pressure regulator 106. Compressed gas from compressed gas source 100 is in communication with pressure regulator 106. Pressure regulator 106 prevents gas pressures from rising above a predetermined threshold level before entering marker 50, to prevent damage of the internal components of marker 50. Pressure regulator 106 includes an adjustment knob 108 that provides for adjustment of one or more operating parameters of pressure regulator 106.

Figure 4B:
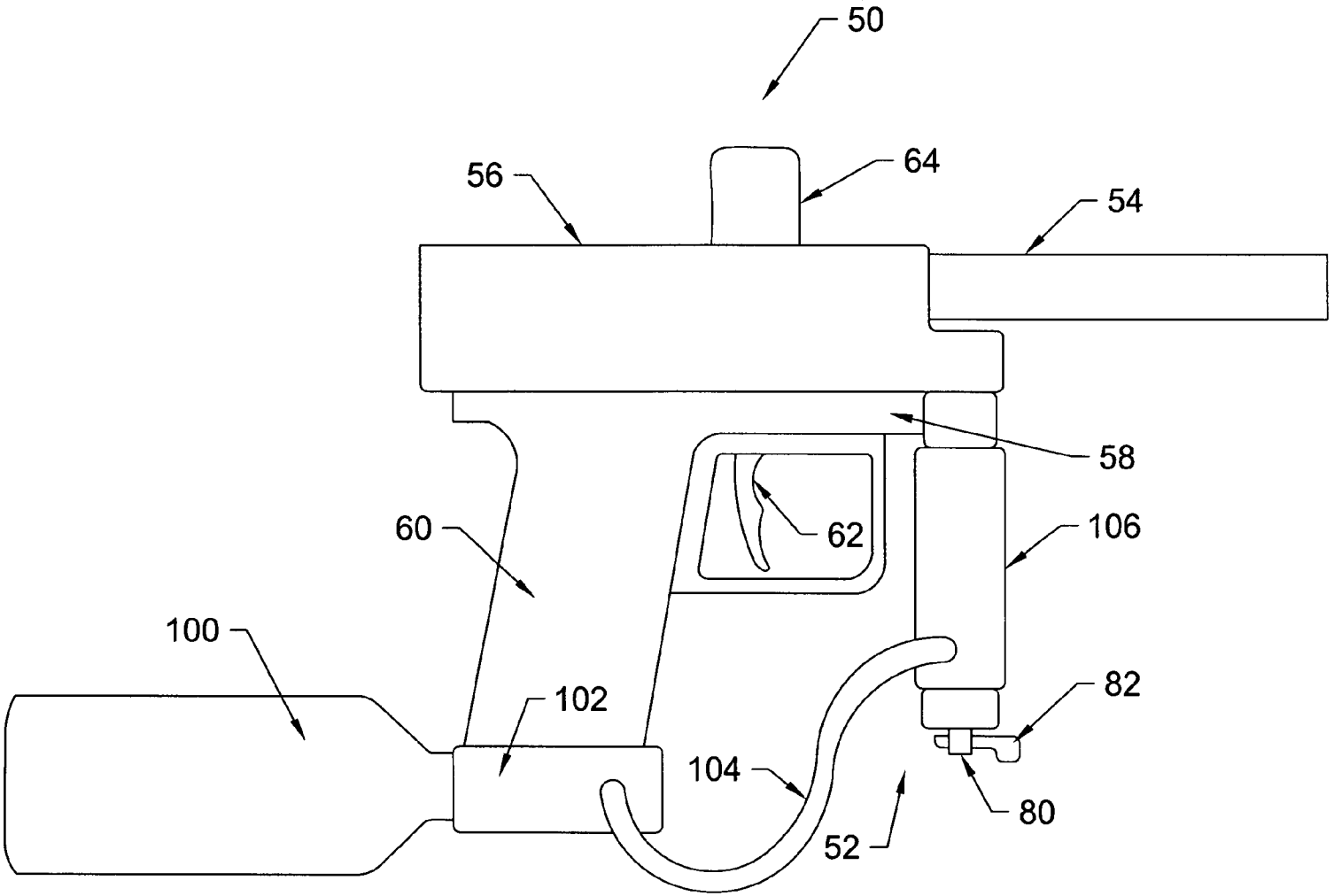

Referring to FIG. 4*b*, in this representative form, velocity adjustment mechanism 52 is configured as an integral part of pressure regulator 106. As such, movement of selector 82 on regulator 106 between an upper set point and a lower set point will cause marker 50 to expel projectiles from barrel 54 between a maximum or upper velocity setting and a minimum or lower velocity setting.

Figure 4C:
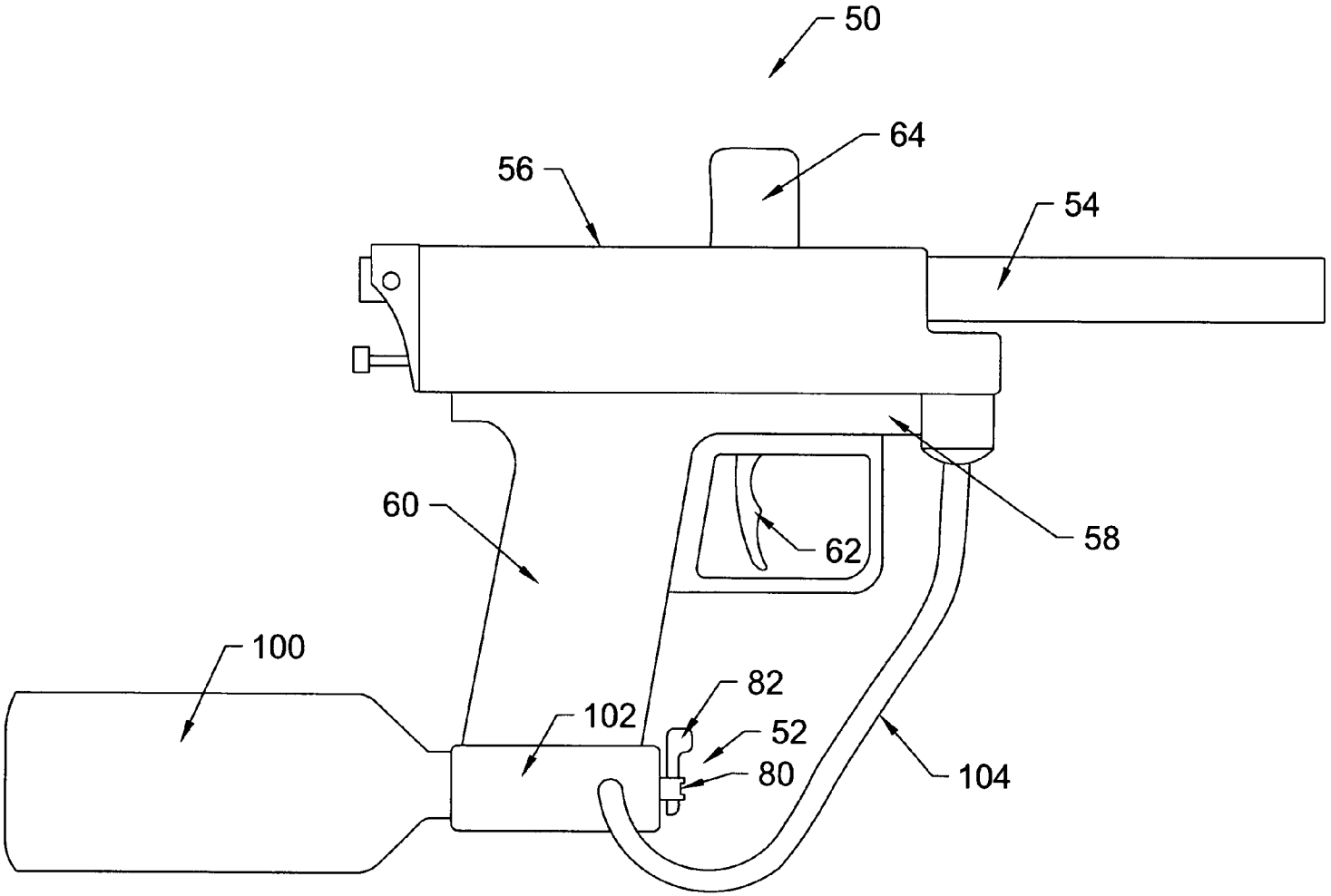

Referring to FIG. 4*c*, in this representative form, velocity adjustment mechanism 52 has been incorporated as a component of tank adapter 102. Movement of selector 82 on tank adapter 102 between an upper set point and a lower set point will cause marker 50 to expel projectiles from barrel 54 between an upper velocity setting and a lower velocity setting. All of the features discussed above with reference to FIGS. 3*a*-3*c* are hereby incorporated by reference into the representative forms set forth in FIGS. 4*b* and 4*c*.

Figure 5:
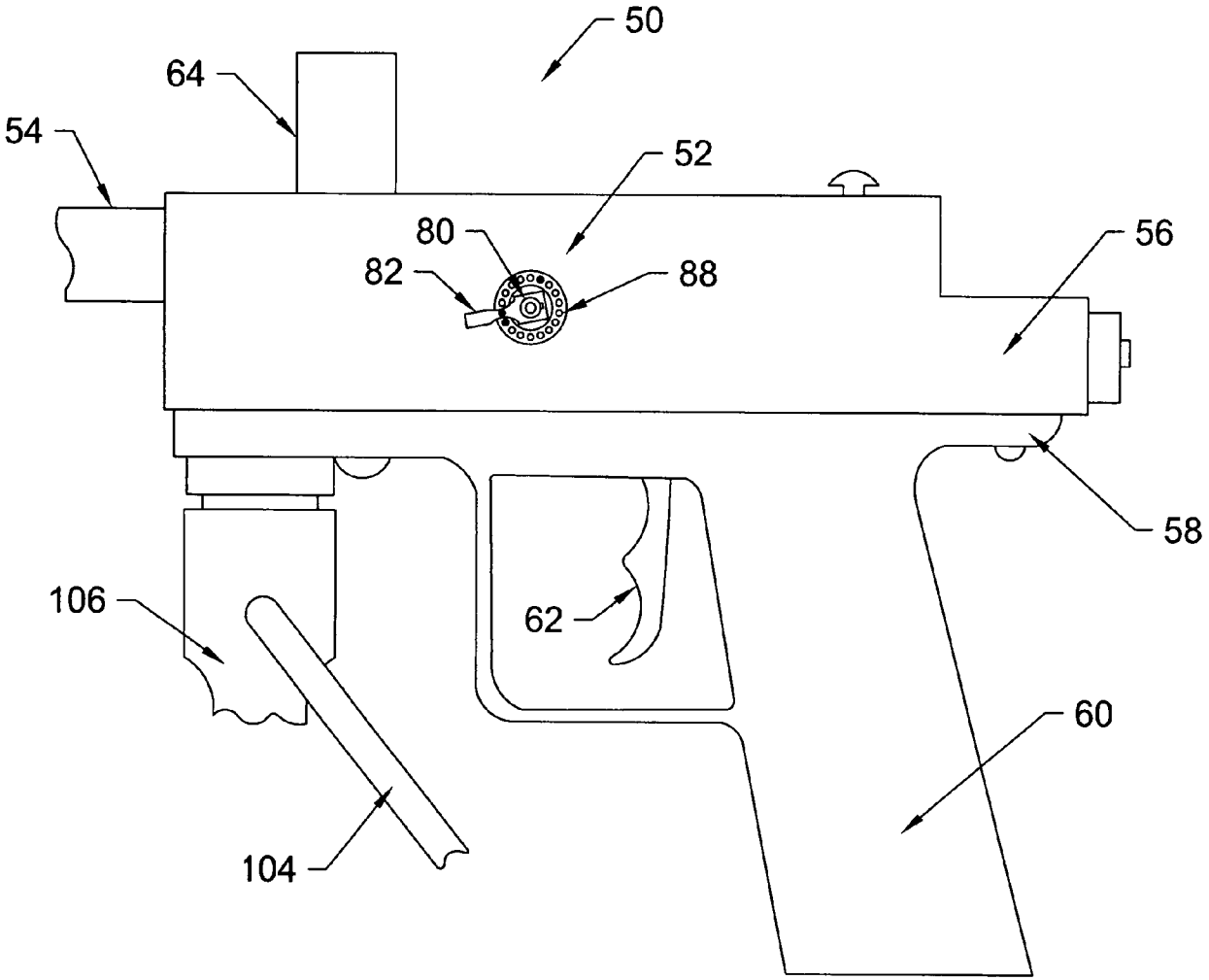
FIG. 5 illustrates a portion of a compressed gas projectile accelerator having a velocity adjustment mechanism.

Referring to FIG. 5, in this representative form, velocity adjustment mechanism 52 is mounted on a side of marker 50. Selector 82 is illustrated as being set at the maximum velocity setting. In this form, rotation of selector 82 clockwise causes main velocity adjustor 80 to block a gas passage in marker 50 thereby allowing user 10 to incrementally reduce the velocity of paintballs that are expelled from barrel 54. For the sake of brevity, those skilled in the art should recognize that the remaining features of marker 50 and velocity adjustment mechanism 52 are the same as those set forth with respect to FIGS. 3*a*-3*c*.

Figure 6:
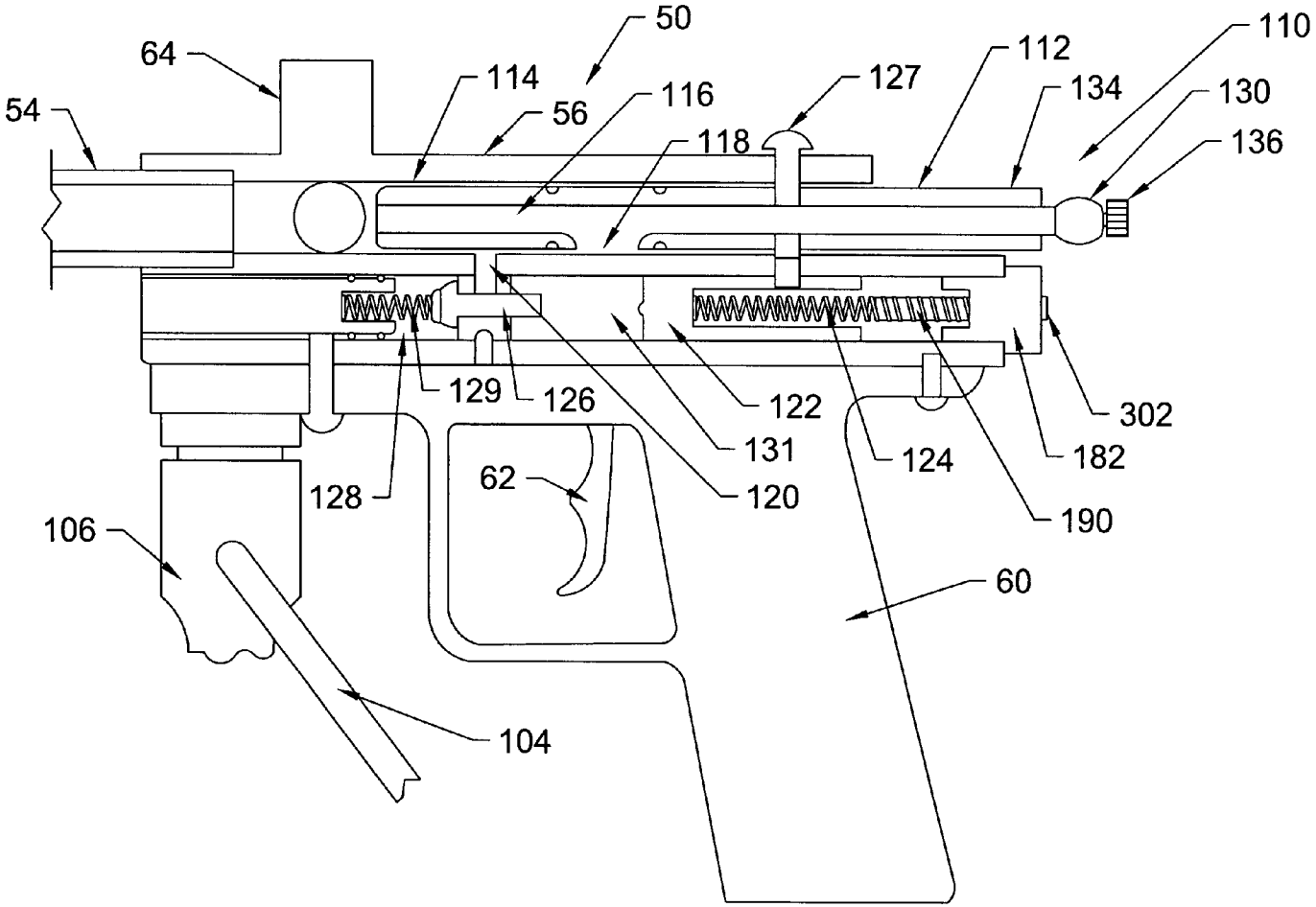
FIG. 6 illustrates a portion of a compressed gas projectile accelerator in cross-sectional form having a velocity adjustment mechanism.

Referring to FIG. 6, another representative form of marker 50 is illustrated that includes a velocity adjustment mechanism 110. In this representative example, marker 50 includes a bolt 112 that travels back and forth along a longitudinal axis in a bolt chamber or bore 114 inside body 56 of marker 50. Bolt 112 includes a gas passage 116 through which compressed gas passes in order to expel paintballs from barrel 54. As bolt 112 travels forward, a gas port 118 in bolt 112 reaches a valve passage 120. During operation, once trigger mechanism 62 is pressed, trigger mechanism 62 releases a hammer 122 that travels forward under the pressure or force provided by a hammer spring 124. After traveling a predetermined distance, hammer 122 strikes a respective end of a valve 126, thereby actuating valve 126.

Actuation of valve 126 causes compressed gas, which is stored in a compressed gas storage chamber 128 on an opposite side of valve 126, to vent through valve passage 120 into gas passage 116 of bolt 112 through gas port 118. It should be appreciated that bolt 112 and hammer 122 move together and gas port 118 is positioned on bolt 112 such that gas port 118 is aligned with valve passage 120 when hammer 122 strikes valve 126. A bolt and hammer connecting pin 127 is used to connect bolt 112 with hammer 122. As such, compressed gas is permitted to travel from compressed gas storage chamber 128 to valve passage 120 and then into gas passage 116 of bolt 112 via gas port 118. This compressed gas is then used to expel a paintball from the barrel 54. After compressed gas is expelled from chamber 128, a spring 129 connected to an end of valve 126 forces valve 126 shut or closed, thereby stopping the flow of compressed gas through valve passage 120. At the same time compressed gas is passed through passage 120, compressed gas is also directed to a hammer chamber 131, which causes hammer 122 and bolt 112 to recoil for another shot.

As illustrated in FIG. 6, an adjustable relief valve 130 is a venting mechanism connected with an exposed end of bolt 112. Adjustable relief valve 130 is used to control or limit the pressure that is supplied from the flow of compressed gas utilized to expel paintballs from barrel 54. As such, when compressed gas is introduced to gas passage 116 of bolt 112, compressed gas travels forward to expel a paintball from barrel 54 and backwards towards venting mechanism on end 134 of bolt 112. Depending on the desired velocity setting, a predetermined amount of compressed gas will vent through velocity adjustment mechanism 110. Adjustable relief valve 130 includes an adjustment mechanism 136, a knob or wheel in this illustrative example, that allows user 10 to adjust velocity settings between the maximum or upper velocity setting and the minimum or lower velocity setting.

Figure 7:
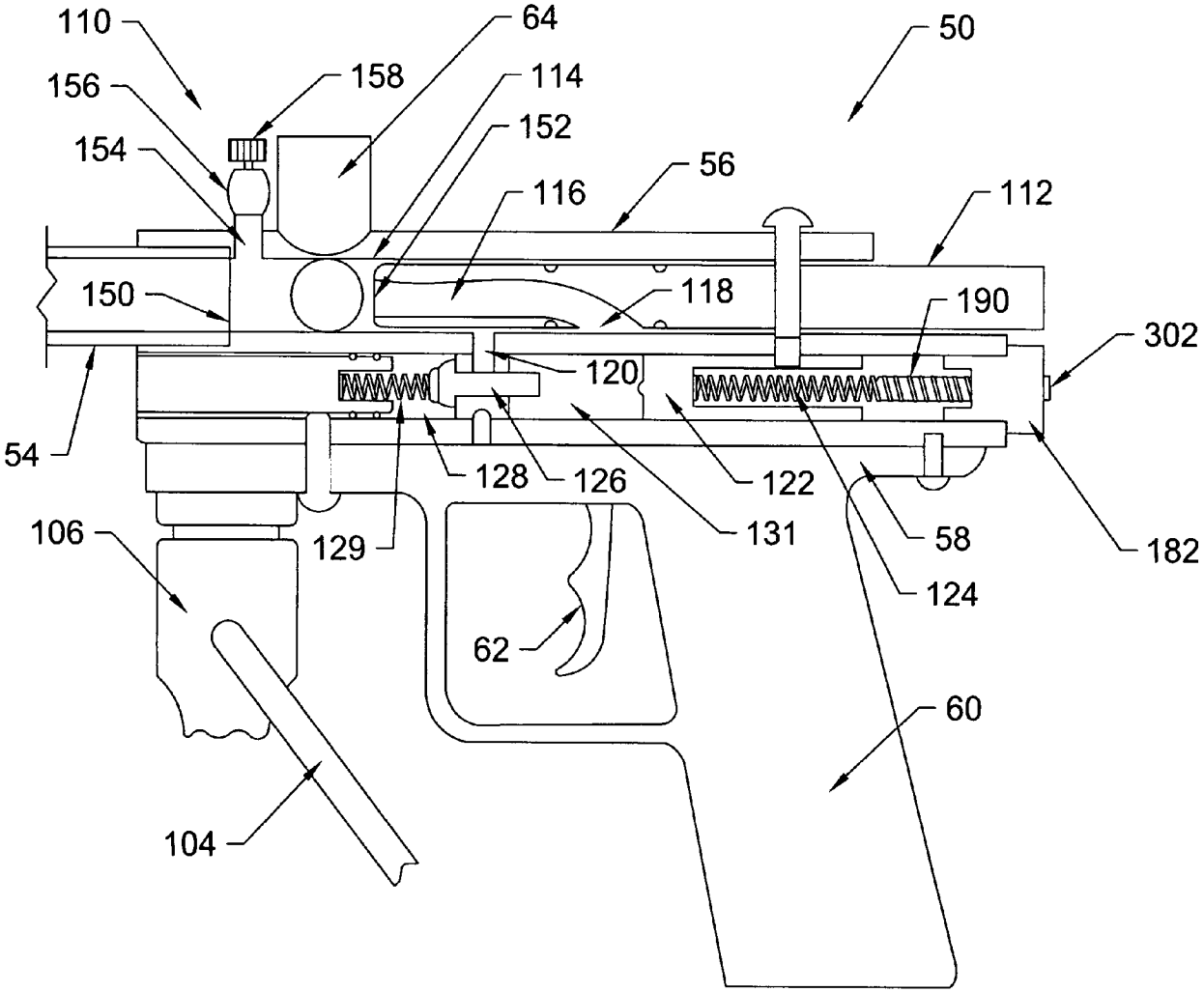
FIG. 7 illustrates a portion of a compressed gas projectile accelerator in cross-sectional form having a velocity adjustment mechanism.

Referring to FIG. 7, in yet another illustrative form, marker 50 includes a velocity adjustment mechanism 110 located on body 56. In particular, velocity adjustment mechanism 110 is a venting mechanism located at an end 150 of barrel 54. In this form, bolt 112 does not travel completely to end 150 of barrel 54. As such, a gap exists between an end 152 of bolt 112 and end 150 of barrel 54 during a firing operation such that a seal is not formed between barrel 54 and bolt 112. Body 56 includes a gas port 154 that is connected with a venting mechanism, which is an adjustable relief valve 156 in this form. As with the previous form, during a firing operation, compressed gas travels through gas passage 116. A predetermined amount of this compressed gas is redirected into gas port 154 and is vented through adjustable relief valve 156. Velocity adjustment mechanism 110 includes a knob 158 that is used by user 10 to control the amount of compressed gas that is released from adjustable relief valve 156. Adjustable relief valve 156 is thus capable of allowing marker 50 to expel projectiles between a maximum or upper velocity setting and a minimum or lower velocity setting.

Figure 8:
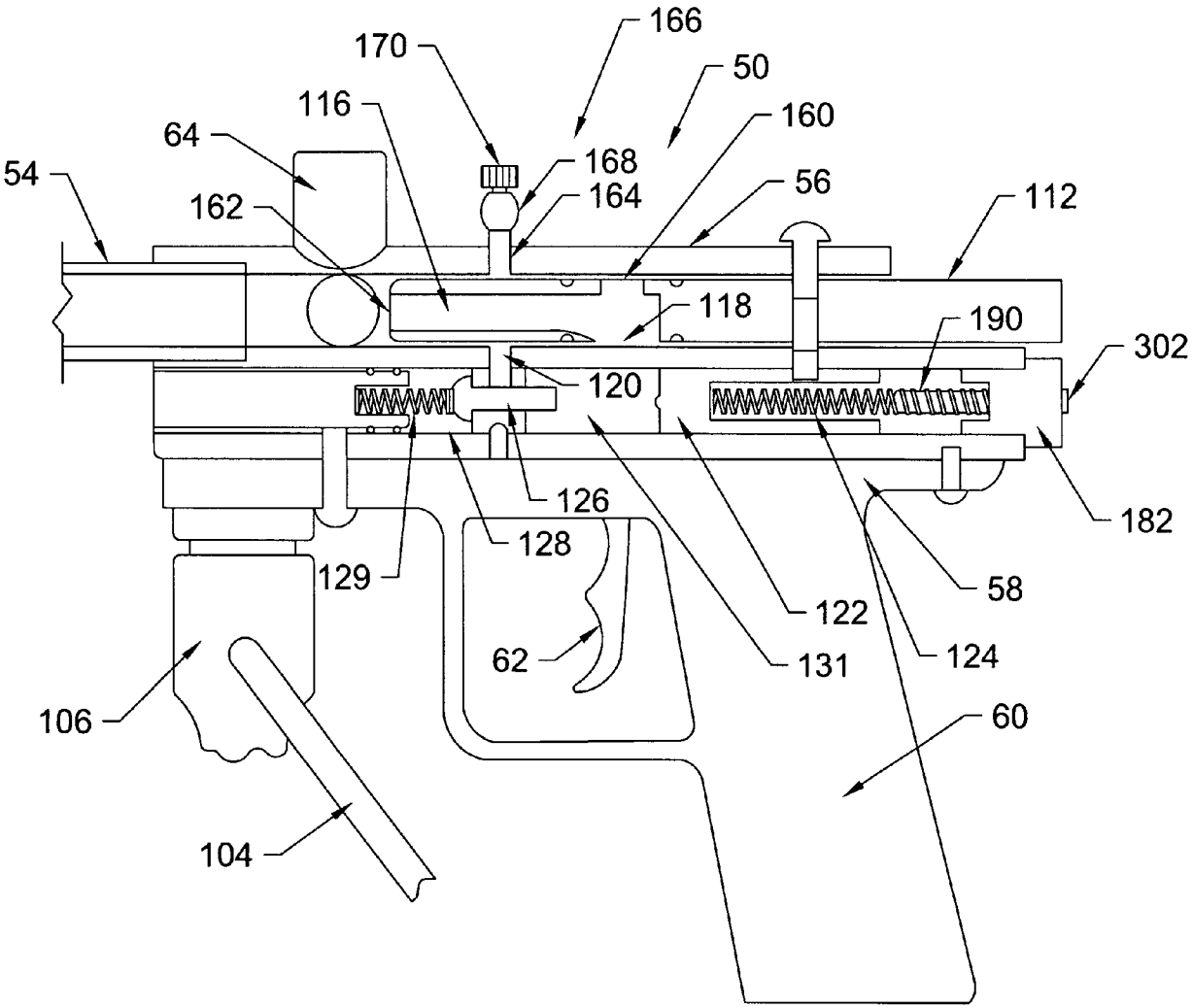
FIG. 8 illustrates a portion of a compressed gas projectile accelerator in cross-sectional form having a velocity adjustment mechanism.

Referring to FIG. 8, in yet another form, bolt 112 includes a gas passage 116 that includes input port 118 and an output port 160, in addition to a port 162 used to expel paintballs from barrel 54. Body 56 includes a gas port 164 that aligns with output port or vent 160 of bolt 112 during a firing operation and redirects a predetermined amount of compressed gas to a venting mechanism. As with the previous forms, marker 50 includes a velocity adjustment mechanism 166, which comprises an adjustable relief valve 168 that acts or functions as the venting mechanism. In this form, velocity adjustment mechanism 166 is located behind feeder 64 in body 56. Adjustable relief valve 168 includes a knob 170 that is used by user 10 to control the amount of compressed gas that is released from adjustable relief valve 168. Adjustable relief valve 168 is thus capable of allowing marker 50 to expel projectiles between a maximum velocity setting and a minimum velocity setting.

Figure 9:
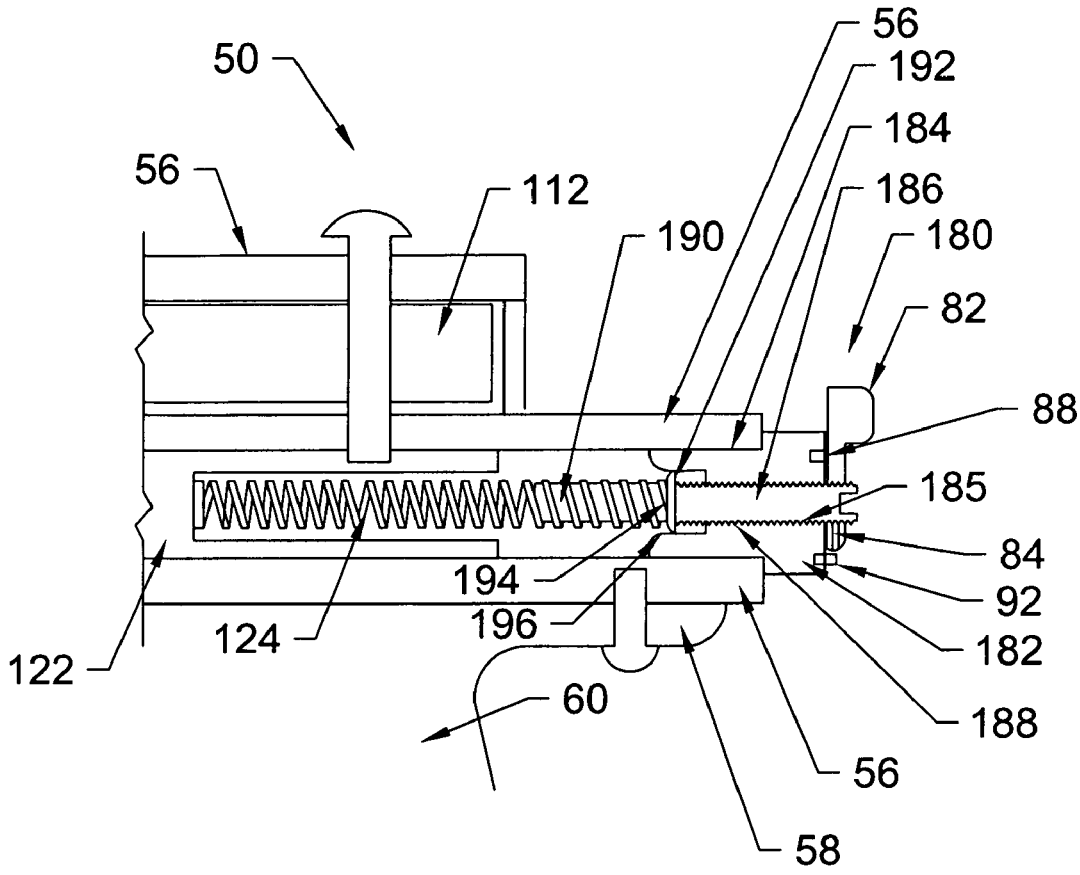
FIG. 9 illustrates a portion of a compressed gas projectile accelerator in cross-sectional form having a velocity adjustment mechanism.

Referring to FIG. 9, a portion of another representative marker 50 is illustrated that includes a velocity adjustment mechanism 180. In this representative form, a hammer spring end cap 182 is connected with an end 184 of body 56. Hammer spring end cap 182 is threadably connected with body 56 or friction fit with body 56. A threaded end 185 of a main velocity adjustor 186 is secured in a threaded aperture 188 of hammer spring end cap 182. Main velocity adjustor 186 has an unthreaded end 190 that extends from threaded end 185 into the body 56 of marker 50 and includes a spring retention collar 192. An end 194 of hammer spring 124 fits around unthreaded end 190 of main velocity adjustor 186 and rests against collar 192. A portion of main velocity adjustor 186 fits within a retention aperture 196 of end cap 182.

In this form, main velocity adjustor 186 is used to set the maximum or upper velocity setting by adjustment of main velocity adjustor 186 in end cap 182. Main velocity adjustor 186 is used to adjust the tension on hammer spring 124. The more tension that is applied to hammer spring 124 (i.e.—by screwing main velocity adjustor 186 further into end cap 182), the harder hammer 122 strikes valve 126 during a firing operation. The harder hammer 122 strikes valve 126, the longer valve 126 is activated and a greater volume of compressed gas is released from valve 126, thereby expelling paintballs from barrel 54 at a higher velocity. Likewise, loosening main velocity adjustor 186, which lessens the tension applied to hammer 122 by spring 124, causes hammer 122 to strike valve 126 with less force during a firing operation. This causes a quicker activation of valve 126 and a release of a lesser gas volume during a firing operation, thereby expelling paintballs from barrel 54 at a lower velocity.

As with the form illustrated in FIGS. 3*a*-3*c*, this form may include an adjustment device 82 (e.g.—a selector lever). Once main velocity adjustor 186 has been set to expel projectiles at an upper velocity level or setting, selector 82 may be connected with or adjusted on main velocity adjustor 186. Although dial 86 is not included in this form, it could be connected with end cap 182. In this form, end cap 182 includes apertures 88. As with the forms disclosed in FIGS. 3*a*-3*c*, pins or set screws 90 and 92 may be positioned in apertures 88 to ensure that selector 82 cannot be adjusted above the upper velocity setting or below the minimum or lower velocity setting. See FIGS. 3*a*-3*c*. Set screw 84 is used to secure selector 82 to main velocity adjustor 186.

Figure 10:
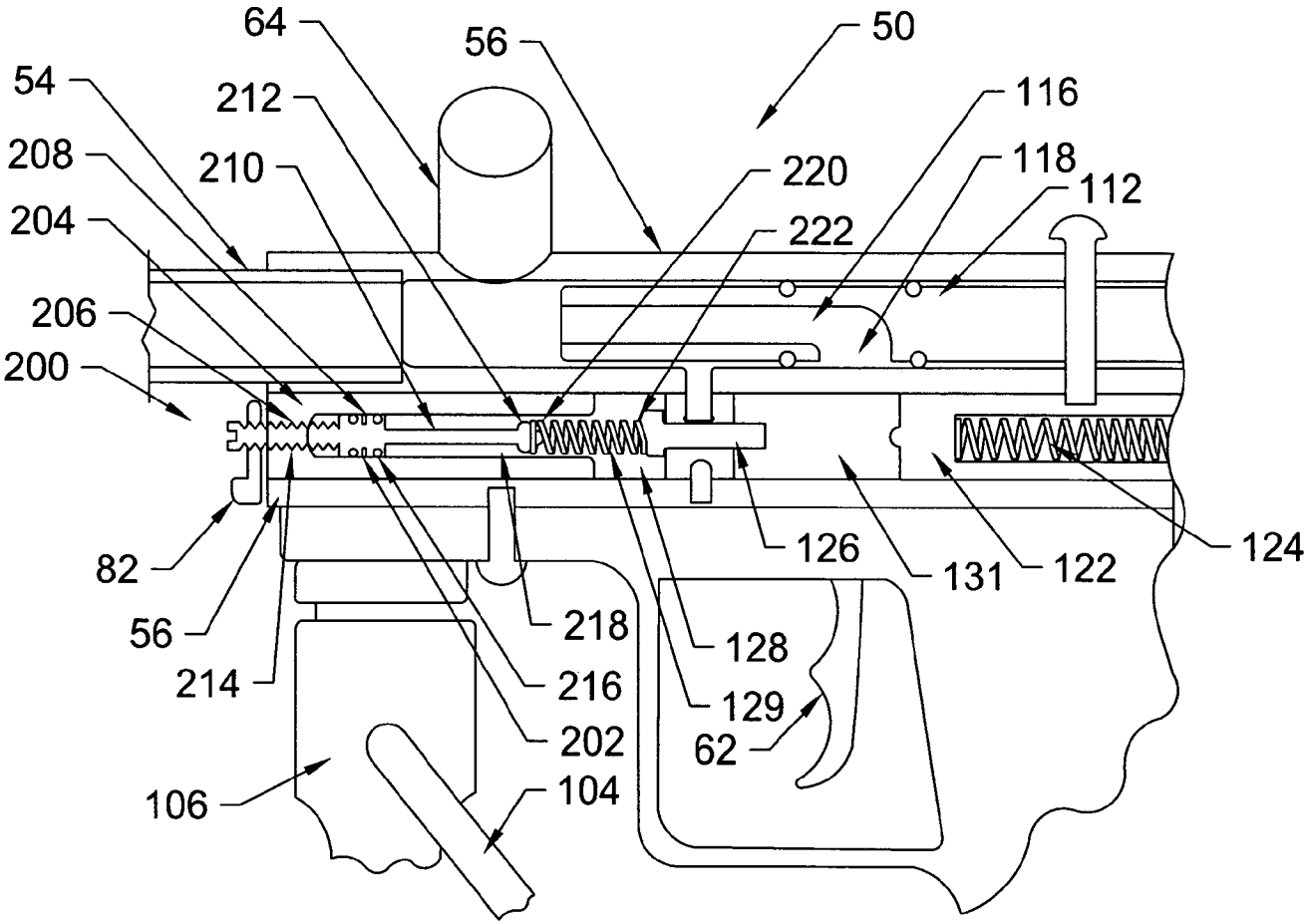
FIG. 10 illustrates a portion of a compressed gas projectile accelerator in cross-sectional form having a velocity adjustment mechanism.

Referring to FIG. 10, in this form, marker 50 includes a velocity adjustment mechanism 200 that adjusts the tension applied by spring 129 to valve 126. As those skilled in the art would recognize, the velocity adjustment mechanism 200 can be configured additionally on marker 50 with or without the above described main velocity adjustor 186. Velocity adjustor 202 is positioned in a valve spring retention member 204. Retention member 204 is connected with body 56 and is positioned in chamber 128. Velocity adjustor 202 includes a threaded end 206, a sealing member 208, an extension member 210, and a collar 212. Threaded end 206 is threaded into an internally threaded aperture 214 of retention member 204 and transitions into sealing member 208. Sealing member 208 includes one or more seals 216 that form a fluid tight seal between sealing member 208 and an internal bore 218 of retention member 204. Extension member 210 extends away from sealing member 208 inside internal bore 218 and transitions into collar 212. An end 220 of spring 129 is connected with collar 212 and an opposite end 222 of spring 129 is connected with an end of valve 126.

Velocity adjustment mechanism 200 works in conjunction with hammer 122 in this form. Velocity adjustment mechanism 200 is used to adjust the force applied to the end of valve 126. The more force that is applied to valve 126, the faster valve 126 shuts after being struck by hammer 122. As such, as threaded end 206 is tightened into retention member 204, more force is applied to valve 126 by spring 129. Likewise, as threaded end 206 is loosened from retention member 204, less force is applied to valve 126. The faster valve 126 closes, the less volume of compressed gas is allowed to pass through valve 126 to expel projectiles from barrel 54 of marker 50. As such, adjustment of threaded end 206 to a predetermined location or setting allows user 10 to set an upper velocity setting. As with the previous embodiments, velocity adjustment device 82 may then be used to raise and lower the velocity at which paintballs are expelled from barrel 54. All other features of this form remain the same as previously set forth with respect to FIGS. 3*a*-3*c* and 9.

Figure 11:
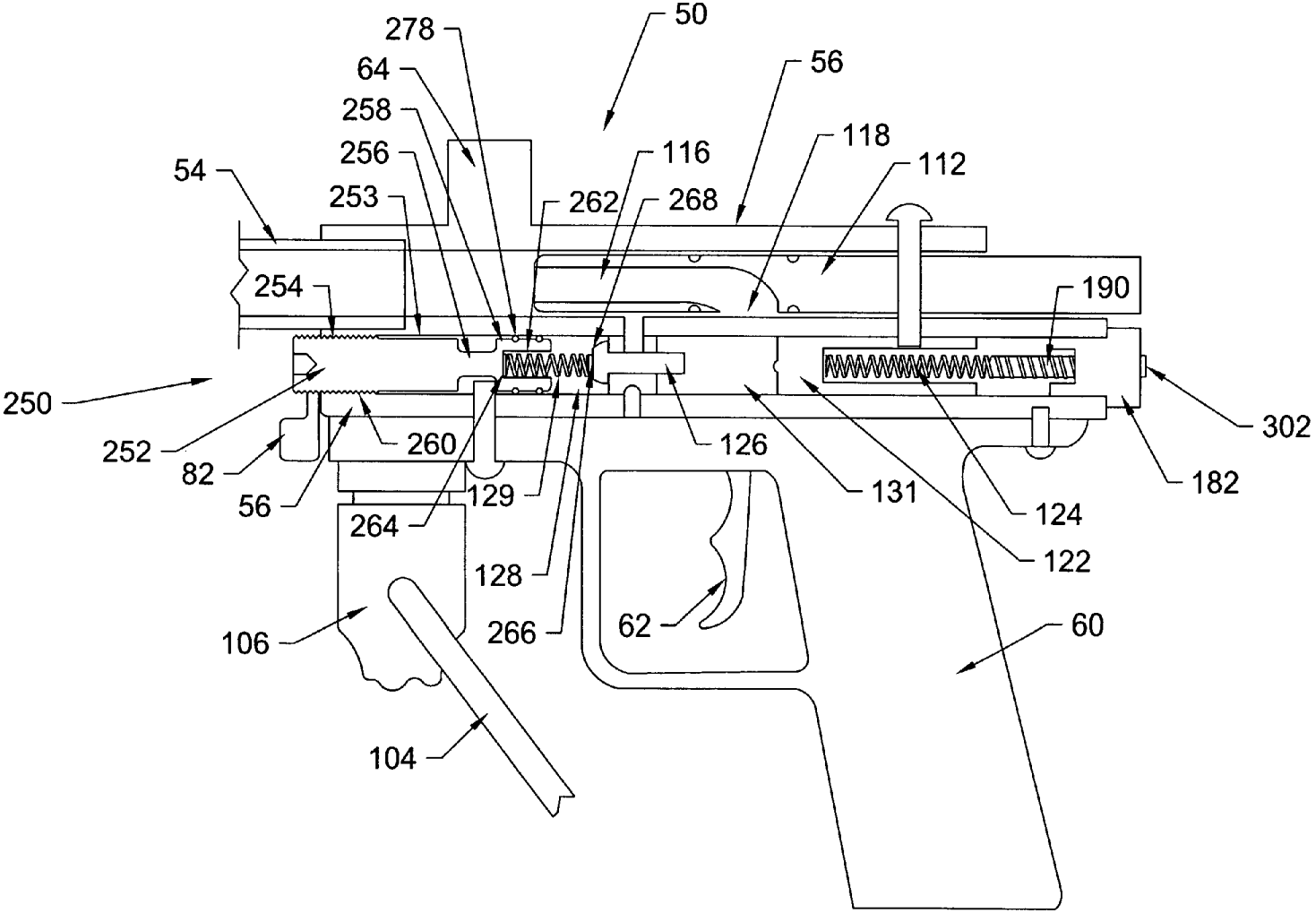
FIG. 11 illustrates a portion of a compressed gas projectile accelerator in cross-sectional form having a velocity adjustment mechanism.

Referring to FIG. 11, in this form, marker 50 includes a velocity adjustment mechanism 250 that adjusts the volume of gas and the tension on spring 129 to control the force at which a paintball is expelled from barrel 54. Velocity adjustment mechanism 250 includes a velocity adjustor 252 that is threaded into body 56 of marker 50. In particular, velocity adjustor 252 is threaded into chamber 128 of marker 50. Velocity adjustor 252 includes a threaded segment 254, an extension segment 256, and a spring receiving segment 258. Threaded segment 254 is threaded into an internally threaded segment 260 of bore 253.

Extension segment 256 extends away from threaded segment 254 a predetermined distance into bore 253. At an opposite end of extension segment 256 is a spring receiving segment 258. Spring receiving segment 258 includes an aperture 262 that receives a first end 264 of spring 129. A second end 266 of spring 129 is connected with or engages an end 268 of valve 126. At least one seal 278 is positioned between spring receiving segment 258 and bore 253 to provide a fluid tight seal for chamber 128, which is defined by bore 253, spring receiving segment 258 and valve 126.

In this form, chamber 128 comprises a compressed gas storage chamber that is refilled with compressed gas after each shot. The compressed gas has a predetermined pressure level, which is controlled by regulator 106, and a predetermined volume. While the pressure level does not change, velocity adjustment mechanism 250 is configured to change the volume or amount of compressed gas that is stored in chamber 128. In addition, the tension on spring 129 is also adjusted which, in turn, changes the amount of force applied to end 266 of spring 129.

During setup, velocity adjustor 252 is configured to allow marker 50 to expel paintballs from barrel 54 at a maximum or upper velocity setting. As with the previous forms, adjustment device or selector 82 allows user 10 to adjust operation of marker 50 between the upper velocity setting and the lower velocity setting. Tightening, or screwing in velocity adjustor 252, increases the tension on spring 129, thereby causing valve 126 to close faster when hammer 122 strikes valve 126, as well as decreases the volume of chamber 128.

Loosening velocity adjustor 252 decreases the force placed on valve 126 and increases the volume of chamber 128 (i.e.—thereby allowing more compressed gas into chamber 128), which allows paintballs to be expelled from barrel 54 at a higher or increased velocity. Movement of adjustment device 82 tightens and loosens velocity adjustor 252, thereby allowing adjustment of marker 50 between the upper velocity setting and lower velocity setting. As with the representative form set forth with respect to FIGS. 3*a*-3*c* and 9, movement of adjustment device 82 is prevented from occurring above or below the upper velocity setting and lower velocity setting.

Figure 12:
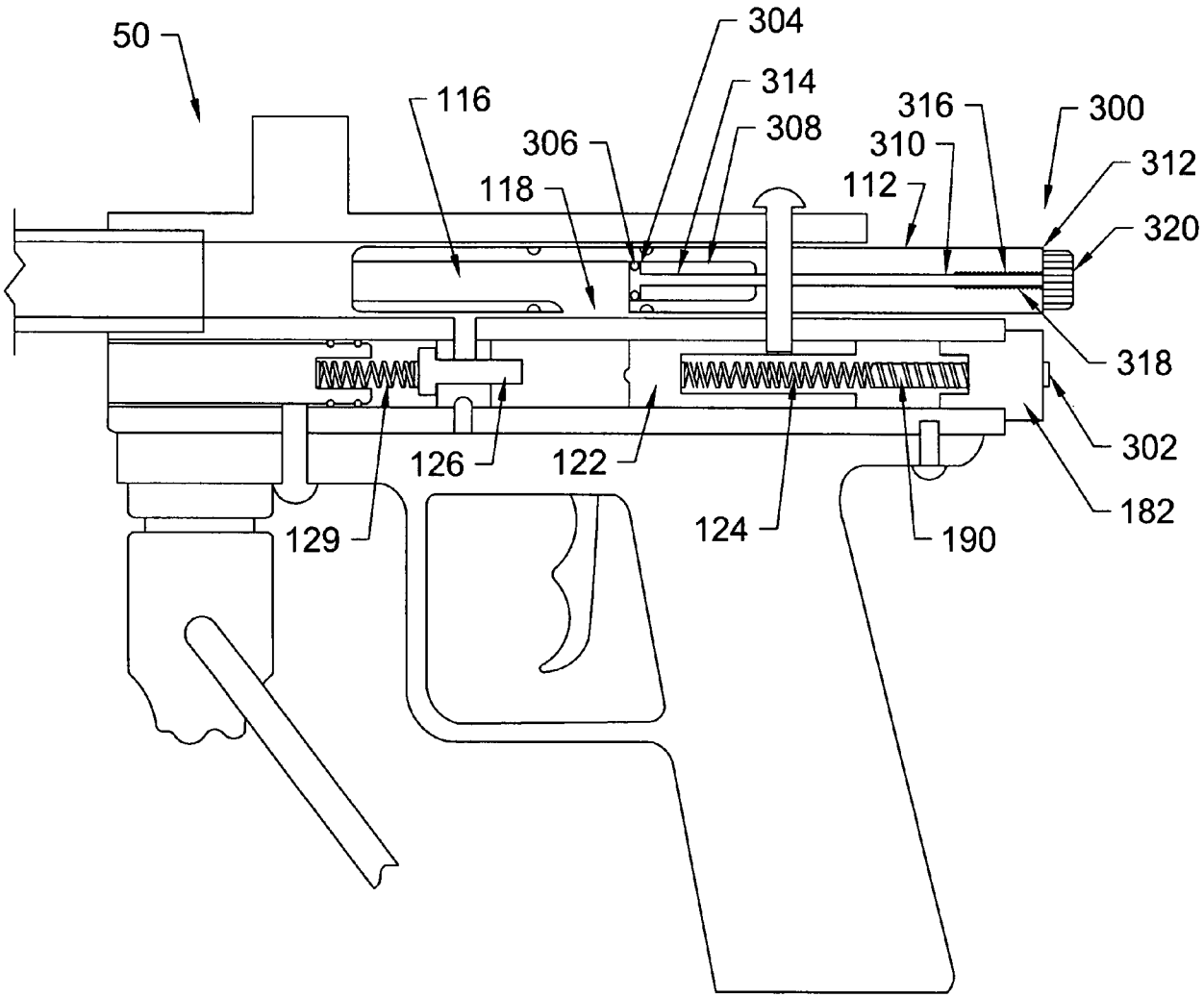
FIG. 12 illustrates a portion of a compressed gas projectile accelerator in cross-sectional form having a velocity adjustment mechanism.

Referring to FIG. 12, yet another form of marker 50 is illustrated that includes a velocity adjustment mechanism 300. In this form, a first velocity adjustor 302 is used to set marker 50 to operate at the maximum or upper velocity setting. This is accomplished by adjusting the tension or force applied to hammer 122 by spring 124 similar to the manner described above. During this adjustment, velocity adjustment mechanism 300 is positioned such that a gas chamber blocker 304 is located in a fully closed or forward position. The outer diameter of gas chamber blocker 304 includes a seal 306 that forms a fluid tight seal with a rear gas chamber 308 in bolt 112.

A rear portion of bolt 112 includes an aperture 310 running from an open end 312 of bolt 112 to rear gas chamber 308. A rod 314 is connected with gas chamber blocker 304 and runs through the rear end of bolt 112 out of open end 312. A portion 316 of the rear end of bolt 112 contains internal threads and a portion 318 of the end of rod 314 contains external threads. An adjustment knob 320 is connected with the exposed end of rod 314.

Adjustment knob 320 is used to screw rod 314 in and out of bolt 112. When adjustment knob 320 is in the fully closed position, gas chamber blocker 304 blocks or closes off chamber 308. As adjustment knob 320 is unscrewed or adjusted outwardly, more of chamber 308 becomes exposed thereby increasing the total volume of gas passage 116. In this form, during a firing operation, valve 126 is configured to release a set amount of compressed gas at a set pressure. As the bolt air chamber, or total size of gas passage 116, increases with the rearward adjustment of rod 314, moving gas chamber blocker 304 further back into gas chamber 308, the velocity of the paintball during a firing operation decreases. This allows user 10 to adjust marker 50 to expel paintballs between the upper velocity setting and a lower velocity setting through the adjustment of knob 320.

Figure 13:
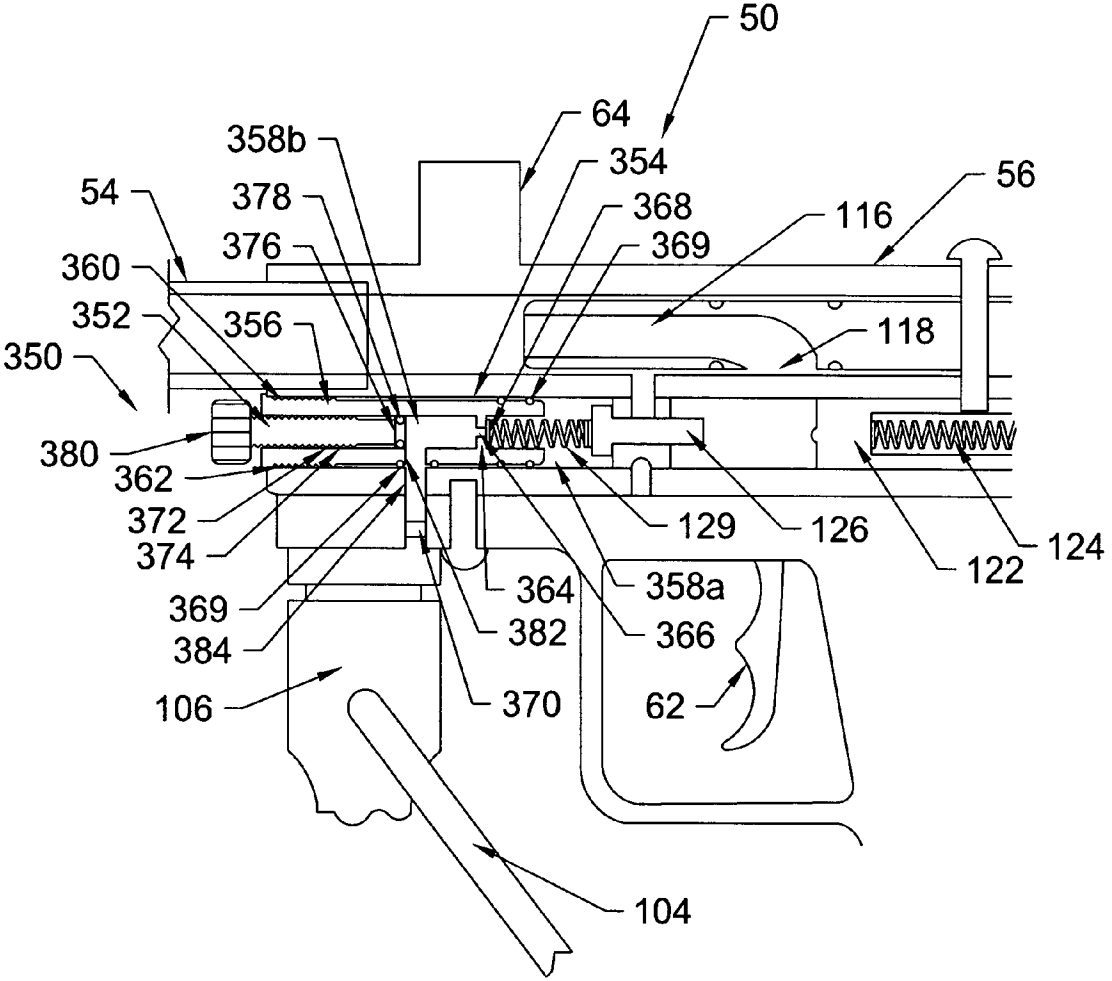
FIG. 13 illustrates a portion of a compressed gas projectile accelerator in cross-sectional form having a velocity adjustment mechanism.

Referring to FIG. 13, yet another representative marker 50 is disclosed that includes a velocity adjustment mechanism 350. This form is similar to that disclosed with respect to FIG. 12 except that instead of the volume adjustment occurring in connection with bolt 112, it takes place with respect to valve 126. Once the upper velocity setting is set using first velocity adjustor 302, as described above, velocity adjustment mechanism 350 can be used to adjust the velocity setting between the upper velocity setting and the lower velocity setting. In this form, a forward end of body 56 includes a longitudinal bore 354 that houses valve 126.

A valve plug 356 is secured in bore 354 that defines a rear gas chamber 358*b* and a forward gas chamber 358*a*, which together define a gas storage chamber. In this form, valve plug 356 includes an outer threaded portion 360 that is threaded into an internally threaded portion 362 of bore 354. Valve plug 356 also includes a spring retention member 364 that includes an aperture 366. An end 368 of spring 129 rests against a respective surface of spring retention member 364. At least one seal 369 is used to provide a fluid tight seal between bore 354 and valve plug 356. A valve 370, which may comprise a solenoid valve, is used to selectively supply compressed gas to the rear gas chamber 358*b* and forward gas chamber 358*a*.

Velocity adjustment mechanism 350 includes a velocity adjustor 352. Velocity adjustor 352 includes an outer threaded portion 372 that engages an inner threaded portion 374 of valve plug 356. Velocity adjustor 352 includes a gas chamber blocker 376. An outer diameter of gas chamber blocker 376 includes a seal 378 that forms a fluid tight seal between gas chamber blocker 376 and an inner wall of rear gas chamber 358*b*. Velocity adjustor 352 also includes an adjustment knob 380 that extends or is positioned outwardly from the end of valve plug 356.

When marker 50 is being adjusted for use or play, velocity adjustor 352 is secured or screwed all the way into rear gas chamber 358*b* as far as possible. Valve plug 354 includes a gas supply aperture 382 that is in alignment with a gas supply passage 384. In this example, gas chamber blocker 376 is in approximate alignment with gas supply aperture 382. Once velocity adjustor 352 is in the forward most position, first velocity adjustor 302 is used to set the upper velocity setting of marker 50.

During play, user 10 can lower the velocity setting of marker 50 by unscrewing or adjusting the position of velocity adjustor 352. Adjusting the position of velocity adjustor 352 outwardly by turning knob 380, increases the volume of rear gas chamber 358*b*. Since compressed gas is supplied to the gas storage chamber, which as previously set forth comprises rear gas storage chamber 358*b* and forward gas storage chamber 358*a*, at a set pressure and set volume, increasing the volume of the gas storage chamber causes a decrease in velocity of paintballs that are expelled from barrel 54.

Figure 14:
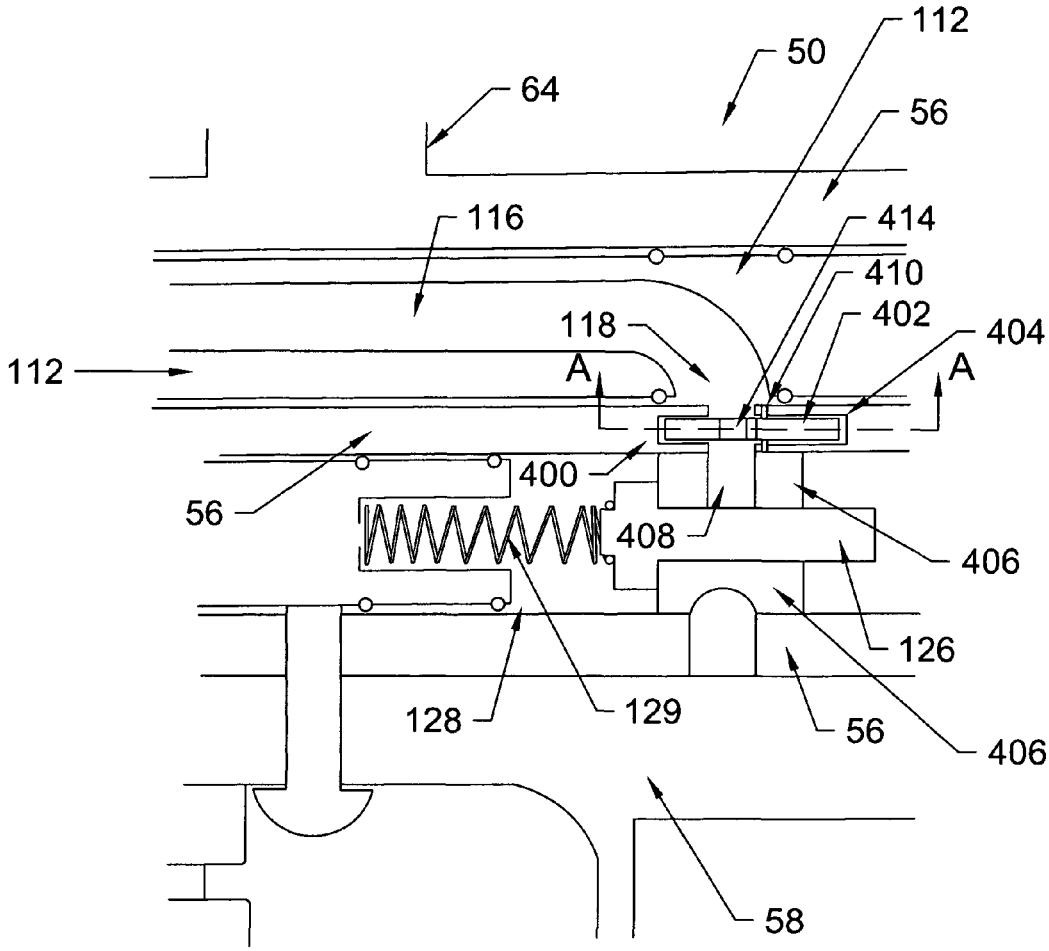
FIG. 14 illustrates a portion of a compressed gas projectile accelerator in cross-sectional form having a velocity adjustment mechanism.

Referring to FIG. 14, a portion of yet another form of marker 50 is illustrated that includes another representative form of a velocity adjustment mechanism 400. Velocity adjustment mechanism 400 includes a dial selector, which in this form comprises an adjustable gas passage blocker 402 positioned in a slot 404 of body 56. Valve 126 includes a valve body 406 that includes a gas port 408. Adjustable gas passage blocker 402 is positioned in slot 404 of body 56 on a swivel pin 410. As set forth in greater detail below, as gas passes from chamber 128 through port 408 of valve 126, the gas also passes through adjustable gas passage blocker 402 before entering input port 118 of gas passage 116 in bolt 112.

Figure 15A:
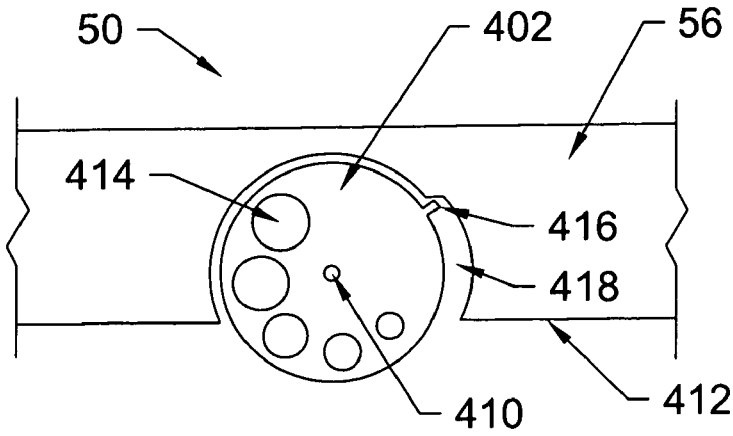
FIGS. 15*a*-15*c* illustrates cross-sectional views of an adjustment dial of a velocity adjustment mechanism.
Figure 15B:
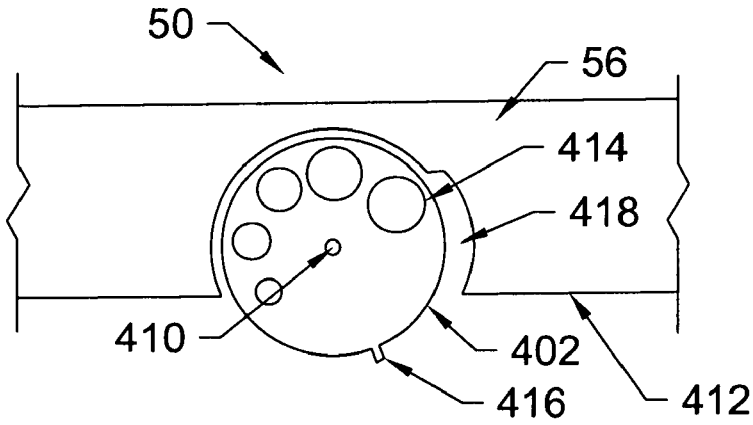
Figure 15C:
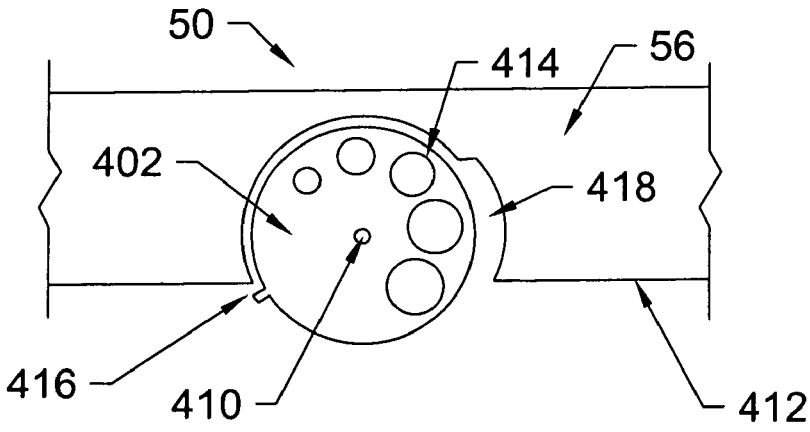

Referring to FIGS. 15*a*-*c*, which depicts top cross sectional views of marker 50 along hash A-A in FIG. 14, a more illustrative view of adjustable gas passage blocker 402 is illustrated. A portion of gas passage blocker 402 protrudes outwardly from a side 412 of body 56. Adjustable gas passage blocker 402 includes a plurality of passages 414 positioned about a circumference or perimeter of adjustable gas passage blocker 402. Each passage 414 has a different diameter or size. Main velocity adjustor 302 (see FIG. 12) is used to set the upper velocity setting of marker 50 and adjustable gas passage blocker 402 is used to lower the velocity setting to different settings as a function of which passage 414 is selected.

As set forth above, gas passage blocker 402 includes passages 414 that are sized according to the amount of restriction that is desired. For example, in FIG. 15*a*, the largest diameter passage 414 is aligned with gas port 408 or valve 126. As such, marker 50 is set at the upper velocity setting. FIG. 15*b* represents a middle setting and FIG. 15*c* represents the lower velocity setting. An adjustment member 416 protrudes outwardly from gas passage blocker 402. A cutaway or slot 418 is located in body 56 that provides a passageway for adjustment member 416 to travel through.

Figure 16:
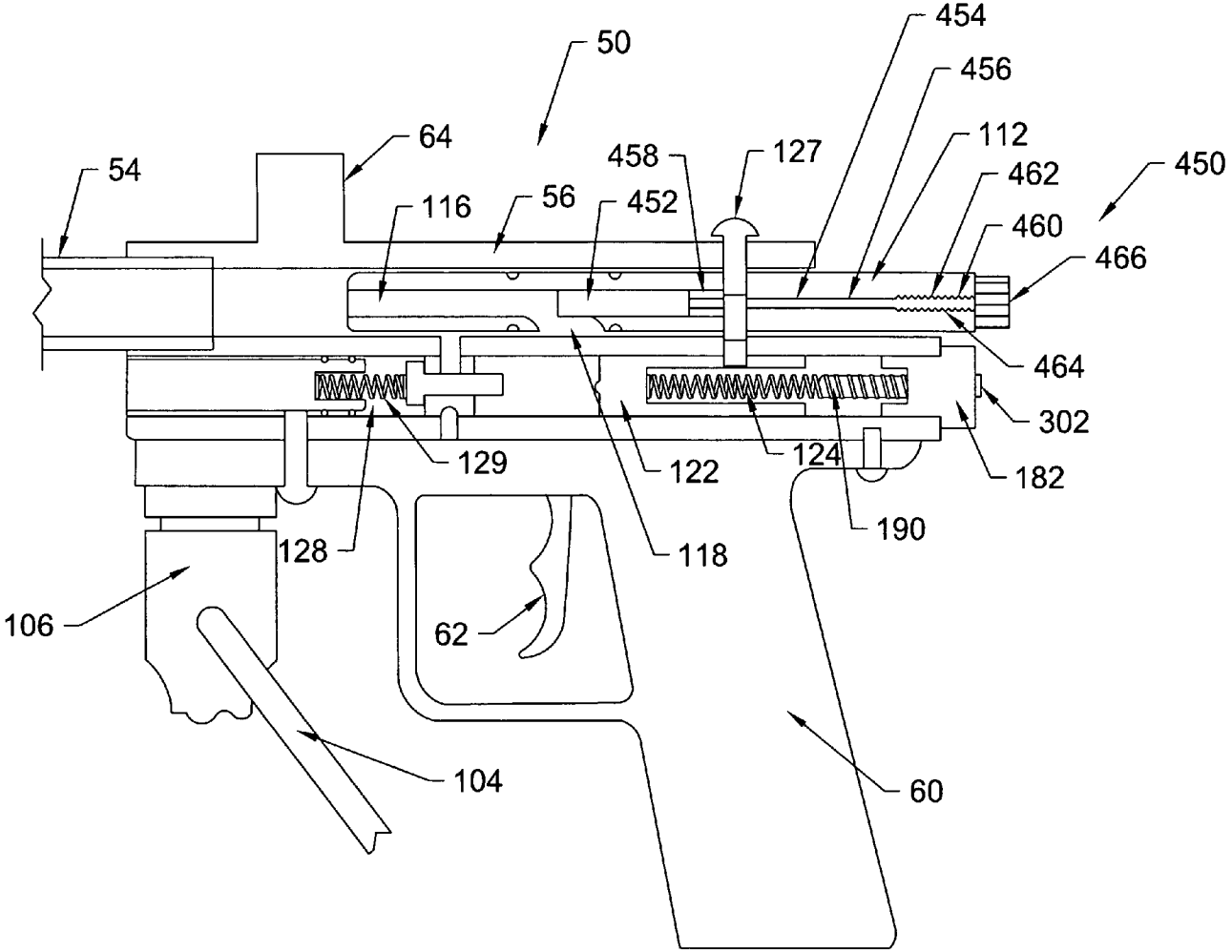
FIG. 16 illustrates a portion of a compressed gas projectile accelerator in cross-sectional form having a velocity adjustment mechanism.

Referring to FIG. 16, in yet another form, marker 50 includes a velocity adjustment mechanism 450 that comprises a bolt passage blocker 452 that is designed to partially block port 118 of bolt 112. Bolt passage blocker 452 is connected with a rod 454 that fits within an aperture 456 in bolt 112. Bolt passage blocker 452 fits within a retaining aperture 458 bored in bolt 112. An end portion 460 of rod 454 includes an externally threaded portion 462 that engages an internally threaded portion 464 of bolt 112. The end of rod 454 is connected with an adjustment knob 466.

Bolt passage blocker 452 is configured to block port 118 of bolt 112 such that gas is restricted from flowing into passage 116 of bolt 112. As knob 466 is screwed in and out, bolt passage blocker 452 adjusts to either increasingly or decreasingly block port 118. As a result, the velocity at which paintballs are expelled from barrel 54 can be adjusted between a maximum velocity setting and a minimum velocity setting. The maximum velocity setting may be configured on marker 50 by using main velocity adjustor 302, as previously set forth. When the maximum velocity is set, bolt passage blocker 452 is set in a fully retracted state or position so that user 10 cannot increase the velocity while on the field to an excessive velocity setting.

Figure 17:
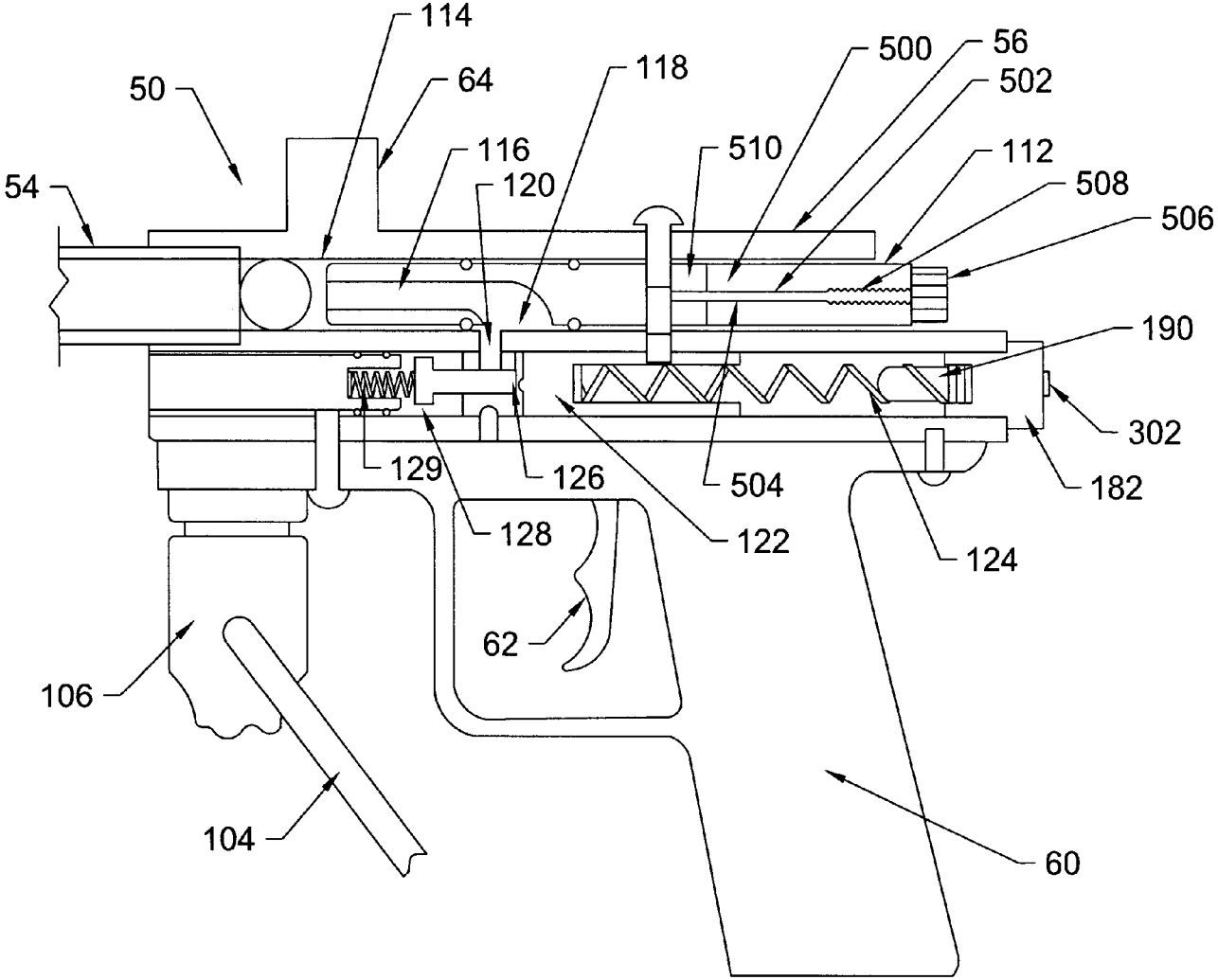
FIG. 17 illustrates a portion of a compressed gas projectile accelerator in cross-sectional form having a velocity adjustment mechanism.

Referring to FIG. 17, another representative form of marker 50 is illustrated that includes a velocity adjustment mechanism 500. In this form, the position of bolt 112 is adjusted such that, during a firing operation, port 118 of bolt 112 is misaligned with gas passage 120. As such, the misalignment of port 118 restricts the flow of compressed gas to passage 116, thereby slowing down the velocity of paintballs being expelled from barrel 54. The bolt and hammer connecting pin 127 is positioned in aperture 510 in bolt 112. One end of a rod 502 is connected with bolt and hammer connecting pin 127. Another end of rod 502 is connected with a knob 506. Rod 502 is positioned in an aperture 504 in bolt 112. An end portion 508 of rod 502 includes external threads that mate with internal threads in aperture 504. With bolt and hammer connecting pin 127 joined to hammer 122, rotation of rod 502 with knob 506 repositions bolt 112 back and forth along a longitudinal axis in bolt chamber or bore 114 inside body 56 of marker 50. The maximum velocity is ready to set when knob 506 is fully unscrewed and bolt 112 is in the forward most position. Then maximum velocity setting is configured on marker 50 using main velocity adjustor 302, as previously set forth.

As knob 506 is screwed in, bolt 112 moves rearward, thereby causing port 118 to become misaligned with passage 120. The more port 118 becomes misaligned with passage 120, by adjustment of bolt 112 on the bolt and hammer connecting pin 127 through knob 506, the lower the velocity of paintballs expelled from barrel 54 will be. In addition, when bolt 112 is misaligned with passage 120, some compressed gas will be vented through feed tube 64, thereby also lowering the velocity of the paintball.

Figure 18:
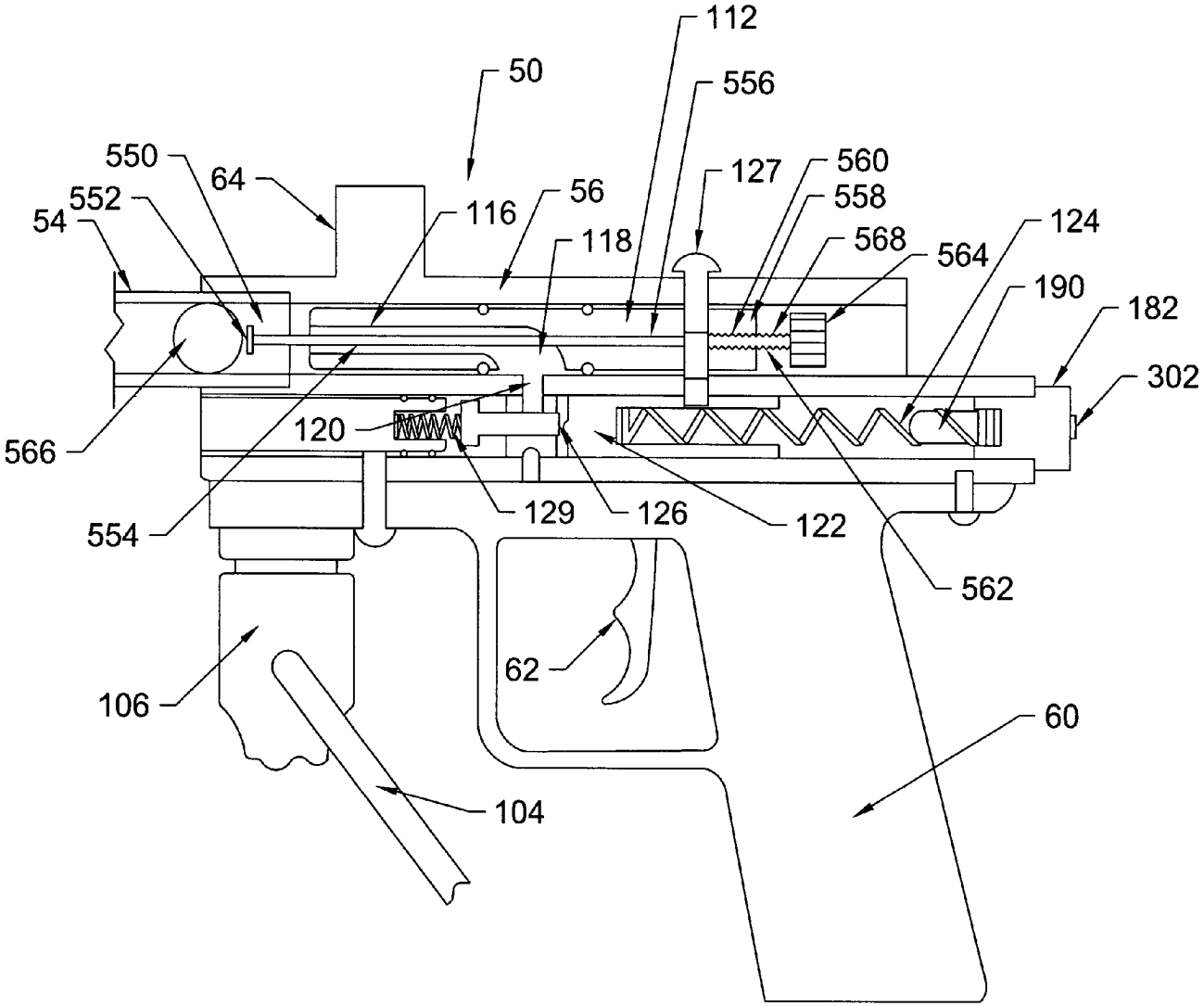
FIG. 18 illustrates a portion of a compressed gas projectile accelerator in cross-sectional form having a velocity adjustment mechanism.

Referring to FIG. 18, another representative form of marker 50 is illustrated that includes a velocity adjustment mechanism 550. In this form, velocity adjustment mechanism 550 creates controllable separation between a paintball 566 and bolt 112. Velocity adjustment mechanism 550 comprises a paintball repositioning member 552 that pushes paintballs further into barrel 54 during a firing operation. Paintball repositioning member 552 is connected with a rod 554 that passes through gas passage 116 and an aperture 556 in bolt 112. An end 558 of bolt 112 includes an internally threaded portion 560 and an end 568 of rod 554 includes an externally threaded portion 562 that threads into internally threaded portion 560. A knob 564 is connected to end 568 of rod 554 and allows adjustment of ball repositioning member 552.

Ball repositioning member 552 is configured to push a paintball 566 into barrel 54 at various depths. The further paintball 566 is pushed out of the breech into barrel 54, the greater the separation from said bolt 112, thereby the slower or less velocity paintball 566 will be expelled from barrel 54 during a firing operation. Knob 564 allows user 10 to adjust the depth at which paintball 566 is pushed into barrel 54, thereby allowing adjustment of the velocity at which paintball 566 is expelled from barrel 54 between an upper velocity setting and a lower velocity setting. As those skilled in the art would recognize, the ball repositioning member 552 is for the controllable separation of the paintball 566 from the compressed gas forces of compressed gas passage 116, of bolt 112.

Referring to FIG. 2, in yet another form of the present invention, an electronic projectile accelerator 50 is disclosed that includes an electronic velocity adjustment mechanism. Electronic projectile accelerator 50 includes an electronic controller, which in this form comprises an electronic circuit board 66 connected with a power source 68. A velocity controller 76, which may comprise a push button control, a dial control, or any other suitable type of control, is connected with the electronic circuit board 66 for allowing a user to selectively set a velocity setting at which projectiles are expelled from a barrel 54.

In one form, the velocity setting is not permitted to go above a predetermined maximum value. A solenoid or solenoid valve 74 is connected with the electronic circuit board 66. The electronic circuit board 66 is configured to control one or more operating parameters of the solenoid 74 as a function of the velocity setting.

The electronic projectile accelerator 50 further includes a sensor 72 configured to permit determination of a velocity of a projectile exiting the electronic projectile accelerator 50. The electronic circuit board 66 is adapted to adjust one or more operating parameters of the electronic projectile accelerator 50, in one form, operating parameters of solenoid 74, as a function of the velocity determination and the velocity setting.

Another aspect of the present invention discloses a kit for retrofitting a compressed gas projectile accelerator 50. The kit includes a velocity adjustment mechanism, as disclosed and described above with respect to FIGS. 1-18, that is configured to allow the compressed gas projectile accelerator 50 to expel projectiles between a defined range of velocity settings. A velocity controller is included in the kit for allowing a user to selectively adjust the velocity adjustment mechanism to a respective velocity setting falling in the range of velocity settings. The exact components included in the kit will vary depending on the design of the compressed gas projectile accelerator 50, but will include one or more of the components described and set forth with respect to FIGS. 1-18.

One form of the present invention discloses a compressed gas projectile accelerator. The compressed gas projectile accelerator includes a velocity adjustment mechanism configured to allow the compressed gas projectile accelerator to expel projectiles between a first velocity setting and a second velocity setting. The velocity adjustment mechanism includes a velocity controller configured to allow a user to selectively select a velocity setting falling between the first velocity setting and the second velocity setting.

Another aspect of the present invention discloses a method, comprising the steps of a) configuring a compressed gas projectile accelerator to expel projectiles at a user selected velocity setting falling between a first velocity setting and a second velocity setting; and b) providing a velocity controller configured to manually allow a user to selectively choose a respective one of a plurality of velocity settings falling between the first and second velocity settings as desired by the user.

Yet another aspect of the present invention discloses a compressed gas projectile accelerator, comprising a compressed gas source; a compressed gas releasing mechanism in communication with said compressed gas source for selectively releasing compressed gas to expel a projectile; and a projectile velocity controller configured to selectively expel projectiles at a manual user selected velocity setting falling within a range of velocity settings.

A further aspect of the present invention discloses a projectile accelerator. The projectile accelerator includes a compressed gas source; a gas releasing mechanism in communication with the compressed gas source; a trigger mechanism for selectively controlling the gas releasing mechanism; and a velocity adjustor associated with the gas releasing mechanism for allowing a user of the projectile accelerator to selectively adjust the velocity at which a projectile is expelled from the projectile accelerator between an upper velocity setting and a lower velocity setting, where adjustment of the velocity adjustor from the upper velocity setting toward the lower velocity setting progressively causes projectiles to be expelled from the projectile accelerator in a lobbed manner.

Another aspect of the present invention discloses an electronic projectile accelerator, comprising: an electronic circuit board; a velocity controller connected with the electronic circuit board for allowing a user to selectively set a velocity setting at which projectiles are expelled from a barrel, where the velocity setting is not permitted to go above a predetermined maximum value; and a solenoid connected with the electronic circuit board, where the electronic circuit board is configured to control one or more operating parameters of the solenoid as a function of the velocity setting.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A compressed gas projectile accelerator, comprising:

a velocity adjustment mechanism configured to allow said compressed gas projectile accelerator to expel projectiles between a maximum velocity setting and a minimum velocity setting, said velocity adjustment mechanism including a velocity controller configured to only allow a user to selectively select a velocity setting between a first velocity setting falling below said maximum velocity setting and said minimum velocity setting, said velocity adjustment mechanism including a flow restriction member configured to selectively restrict an amount of compressed gas used to expel projectiles as a function of said velocity setting, where said velocity controller is connected with said flow restriction member and is configured to be adjusted between said first velocity setting and said minimum velocity setting thereby setting said compressed gas projectile accelerator at a respective velocity setting, said velocity adjustment mechanism including a dial, said dial including a plurality of apertures located about a circumference of said dial, where a first stopping member placed in a first aperture of said plurality of apertures is used to set said first velocity setting and a second stopping member placed in a second aperture of said plurality of apertures is used to set said minimum velocity setting, where said first and second stopping members restrict movement of said velocity controller beyond said first and second stopping members.

2. The compressed gas projectile accelerator of claim 1, where said velocity controller comprises a selector, said selector including a detainment mechanism that engages a respective one of said plurality of apertures in said dial to prevent inadvertent movement of said selector.

3. The compressed gas projectile accelerator of claim 1, where said velocity adjustment mechanism is located in a predetermined location, where said predetermined location is selected from the group consisting of a frame, a regulator, and a compressed gas supply.

4. The compressed gas projectile accelerator of claim 1, where said velocity adjustment mechanism is configured to selectively adjust a volume of compressed gas supplied to expel projectiles as a function of said velocity setting.

5. The compressed gas projectile accelerator of claim 1, where said velocity adjustment mechanism is configured to selectively adjust the pressure of said compressed gas supplied to expel projectiles as a function of said velocity setting.

6. The compressed gas projectile accelerator of claim 1, where said velocity adjustment mechanism is configured to adjust a timed release of compressed gas supplied to expel projectiles as a function of said velocity setting.

7. The compressed gas projectile accelerator of claim 1, where said velocity adjustment mechanism comprises a secondary velocity adjuster on a compressed gas projectile accelerator with a main velocity adjuster.

8. The compressed gas projectile accelerator of claim 1, where said velocity adjustment mechanism includes an adjustable venting mechanism positioned in a gas flow path utilized to expel projectiles.

9. The compressed gas projectile accelerator of claim 1, where said velocity adjustment mechanism is configured to adjust a tension setting of a valve spring to adjust said velocity setting.

10. The compressed gas projectile accelerator of claim 1, where said velocity adjustment mechanism is configured to adjust a time setting of a valve to adjust said velocity setting.

11. The compressed gas projectile accelerator of claim 1, where said velocity adjustment mechanism is configured to adjust a volume of compressed gas utilized to expel projectiles from said compressed gas projectile accelerator to adjust said velocity setting.

12. The compressed gas projectile accelerator of claim 1, where said velocity adjustment mechanism is configured to adjust a size of a flow path utilized to direct compressed gas through the compressed gas projectile accelerator to adjust said velocity setting.

13. The compressed gas projectile accelerator of claim 1, where said velocity adjustment mechanism is configured to redirect a gas flow path to adjust said velocity setting.

14. The compressed gas projectile accelerator of claim 1, where said velocity adjustment mechanism is configured to adjust a size of a gas chamber to adjust said velocity setting.

15. The compressed gas projectile accelerator of claim 1, where said velocity adjustment mechanism includes an electronic controller.

16. The compressed gas projectile accelerator of claim 15, where said electronic controller is configured to control one or more operational parameters to control said velocity setting.

* * * * *